US011811130B2

(12) United States Patent
Bardo et al.

(10) Patent No.: US 11,811,130 B2
(45) Date of Patent: Nov. 7, 2023

(54) SINGLE AXIS ARTICULATING ANTENNA POSITIONER FOR TUBE LAUNCHED OR CONFORMAL APPLICATIONS

(71) Applicant: BAE Systems Information and Electronic Systems Integration Inc., Nashua, NH (US)

(72) Inventors: Jason E. Bardo, Chelmsford, MA (US); Wesley N. Allen, Amherst, NH (US); Benjamin G. McMahon, Nottingham, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 17/178,372

(22) Filed: Feb. 18, 2021

(65) Prior Publication Data

US 2022/0263215 A1 Aug. 18, 2022

(51) Int. Cl.

| | |
|---|---|
| ***H01Q 1/12*** | (2006.01) |
| ***H01Q 1/32*** | (2006.01) |
| ***H01Q 3/00*** | (2006.01) |
| ***H01Q 1/08*** | (2006.01) |

(52) U.S. Cl.

CPC ..... *H01Q 1/125* (2013.01); *H01Q 1/08* (2013.01); *H01Q 1/1235* (2013.01); *H01Q 1/32* (2013.01); *H01Q 3/005* (2013.01)

(58) Field of Classification Search

CPC ..... H01Q 1/125; H01Q 1/08; H01Q 1/1235; H01Q 1/32; H01Q 3/005

See application file for complete search history.

(56) References Cited

U.S. PATENT DOCUMENTS

| | | | | |
|---|---|---|---|---|
| 2020/0061839 | A1* | 2/2020 | Deyle | G06Q 10/087 |
| 2020/0203798 | A1* | 6/2020 | Freebury | H01Q 19/193 |

OTHER PUBLICATIONS

International Search Report, PCT/US2022/016513, dated Sep. 26, 2022, 7 pages.

* cited by examiner

*Primary Examiner* — David E Lotter

(74) *Attorney, Agent, or Firm* — Sand, Sebolt & Wernow LPA; Gary McFaline

(57) ABSTRACT

An antenna positioner provided on a deployable vehicle. The antenna positioner includes a base and a frame having a plurality of plates oriented at an angle relative to one another. Each plate may include a low band antenna and a high band antenna. The base is located inside a chamber of the deployable vehicle. The frame is movable relative to the base between a collapsed position, where the entire frame is positioned within the chamber, and an extended position wherein at least a portion of the frame extends outwardly through an opening in the deployable vehicle's exterior wall. The frame is pivotally engaged with the base and a gearing mechanism pivots the frame between the collapsed position and the extended position to arrange the antennas at a desired orientation relative to the deployable vehicle's exterior wall so as to maximize the antenna's near-vertical Field of View (FoV).

20 Claims, 11 Drawing Sheets

SINGLE AXIS ARTICULATING ANTENNA POSITIONER FOR TUBE LAUNCHED OR CONFORMAL APPLICATIONS

STATEMENT OF GOVERNMENT INTEREST

This invention was made with government support under Contract No. N00014-19-C-1077 awarded by U.S. Navy. The government has certain rights in the invention.

TECHNICAL FIELD

The present disclosure relates to deployable military decoy vehicles and/or satellites, particularly airborne deployable military decoy vehicles. More particularly, the present disclosure relates to an antenna positioner movable from a collapsed position inside a chamber of the deployable military decoy vehicle to a deployed and extended position where at least part of the antenna positioner extends outwardly beyond the deployable decoy vehicle's exterior wall. Similarly, the antenna positioner may be used on a satellite. More particularly, the present disclosure relates to an antenna positioner movable from a collapsed position inside a chamber of the satellite to a deployed and extended position where at least part of the antenna positioner extends outwardly beyond the satellite's exterior wall. Specifically, the present disclosure relates to an antenna positioner including at least one antenna, wherein the antenna positioner is pivotable between the collapsed position and the extended position after launch of the deployable vehicle and thereby improves the Field of View (FoV) of the deployable vehicle.

BACKGROUND

In current military technology, some naval vessels are equipped to protect themselves and the crew members on-board from incoming threats, i.e., missiles, through the utilization of electronic warfare ("EW") decoys. These EW decoys may be unmanned aerial vehicles ("UAVs") that are launched from the naval vessel to a predetermined location at a predetermined distance and elevation away from the naval vessel. Upon reaching its predetermined location, the UAV is designed to hover in place utilizing one or more propellers and to view the sky utilizing one or more antennas to see and track the incoming threat. The UAV may deploy various diversion elements, such as flares, smoke, and chaff material, or emit electronic signals to distract the incoming missile. In some instances, the deployed diversion elements may create a form of an apparent naval vessel located a distance away from the actual naval vessel. The diversion elements will aid in redirecting the threat from the actual naval vessel. The UAV's one or more antennas may continuously view and monitor the incoming threat and the UAV may relay such information to the actual naval vessel.

Throughout this disclosure these EW decoys and UAVs will be generally referred to as "decoy vehicles" and the term should be understood to cover any type of launched equipment that acts as a decoy to divert threats. It will be understood that these decoy vehicles may also be launched to protect land-based assets.

Conventional decoy vehicles may be provided with one or more antennas that are able to view a portion of the sky surrounding the decoy vehicle. The portion of the sky that is able to be viewed with an antenna is called the antenna's Field of View (FoV). The FoV is captured by the one or more antennas and the data relating to the same may be utilized to watch for incoming threats and to determine where to deploy diversion elements. Presently known decoy vehicles normally include one or more antennas disposed within the interior of the decoy vehicle, particularly towards a leading end thereof. The one or more antennas provided on conventional decoy vehicles may be disposed under a radome and may be mounted on a pivotable mechanism (e.g., a gimbal, gyroscope, etc.) that is able to move the antennas inside of the decoy vehicle to improve the FoV. Conventional decoy vehicles may additionally or alternatively include one or more antennas located in a central or lower portion of the decoy vehicle. Antennas in the central or lower portion will capture a different FoV from one or more antennas located at the leading end of the decoy vehicle. The antennas provided on presently known, conventional decoy vehicles are capable of capturing a horizontal FoV and are less capable of capturing a near-vertical FoV. This is especially true where the antennas are located in a central or lower portion of the decoy vehicle because other components within the interior of the decoy vehicle tend to obstruct the FoV.

SUMMARY

Based on the conventional technology and current problems in the field of this invention as to analyzing a near-vertical Field of View (FoV) of a decoy vehicle, an improvement is needed.

In one aspect, an exemplary embodiment of the present disclosure may provide an antenna positioner disposed in a deployable vehicle. The antenna positioner may include a base, a frame, and at least one antenna provided on the frame. The base is located inside a chamber of the deployable vehicle. The frame is moveable relative to base between a collapsed position and an extended position. The frame is disposed inside the chamber in the collapsed position and when moved to the extended position, at least a portion of the frame extends outside of the chamber and beyond an exterior wall of the deployable vehicle.

In another aspect, an exemplary embodiment of the present disclosure may provide a system that includes a deployable vehicle, an antenna positioner, and a cover. The deployable vehicle defines a chamber that is accessible through an opening defined in an exterior wall of the deployable vehicle. The antenna positioner includes a base, a frame, and at least one antenna provided on the frame. The base is located inside the chamber of the deployable vehicle. The frame is moveable relative to base between a collapsed position and an extended position. In particular, the frame is disposed inside the chamber in the collapsed position and, when moved to the extended position, at least a portion of the frame extends outside the chamber through the opening and beyond the deployable vehicle's exterior wall. The cover extends over the opening to the chamber when the frame is in the collapsed position and is removed from over the opening as the frame is moved to the extended position.

In yet another aspect, an exemplary embodiment of the present disclosure may provide a method of improving a FoV of a decoy vehicle. The method comprising steps of providing access to a chamber of the deployable vehicle through an opening defined by an exterior wall of the deployable vehicle; locating an antenna positioner within the chamber of the deployable vehicle, and providing at least one antenna on the antenna positioner; launching the deployable vehicle to a predetermined distance and altitude; moving at least portion of the antenna positioner from inside the chamber through the opening in the exterior wall to an extended position outside of the chamber; and viewing, by the at least one antenna, a FoV about the deployable vehicle.

BRIEF DESCRIPTION OF THE SEVERAL VIEWS OF THE DRAWINGS

Sample embodiments of the present disclosure are set forth in the following description, are shown in the drawings and are particularly and distinctly pointed out and set forth in the appended claims.

Similar numbers refer to similar parts throughout the drawings.

DETAILED DESCRIPTION

The terms "articulate," "articulating," or "articulation" used herein may include movements of pivoting, rotating, or moving about an axis.

Figure 1:
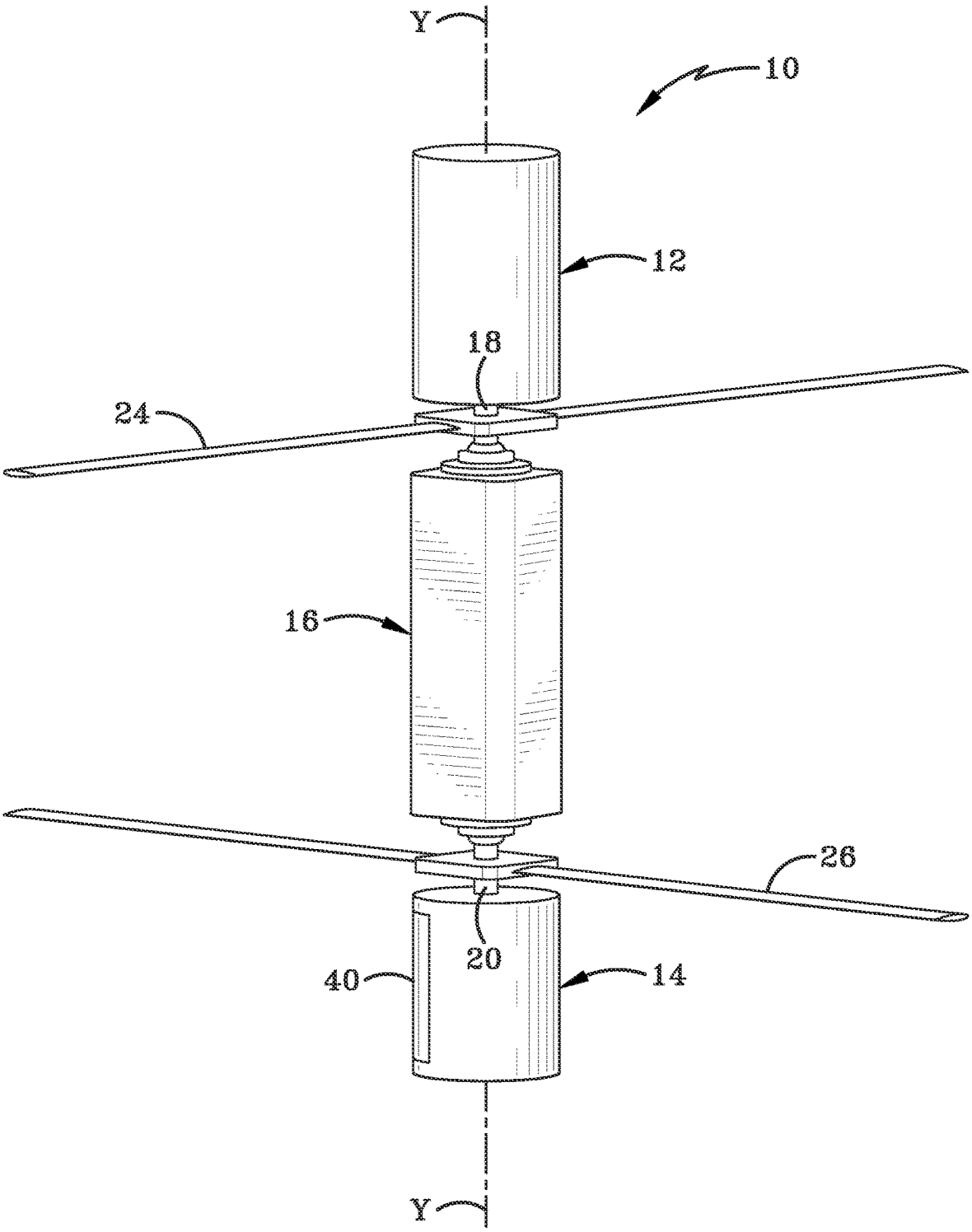
FIG. 1 illustrates a perspective view of a decoy vehicle which includes an antenna positioner in accordance with the present disclosure, where the antenna positioner is hidden from view behind a cover provided on the exterior wall of the decoy vehicle.

FIG. 1 illustrates an electronic warfare ("EW") decoy, an unmanned aerial decoy vehicle ("UAV"), an airborne military diversion decoy vehicle, which will be generally referred herein as a "decoy vehicle" or a "deployable vehicle". The decoy vehicle is indicated by the reference number 10. It will be understood that the illustrated decoy vehicle 10 is exemplary only and any type of decoy vehicle 10 is contemplated to be represented by the illustrated device. Other types of deployable vehicle that are represented by decoy vehicle 10 include satellites, Unmanned Underwater Vehicles (UUVs), or any type of deployable airborne vehicles.

The decoy vehicle 10 has an upper portion 12, a lower portion 14 that diametrically opposes the upper portion 12, a middle portion 16 disposed between the upper portion 12 and the lower portion 14. A longitudinal axis "Y" of decoy vehicle 10 extends from the upper portion 12, through the middle portion 16, to the lower portion 14. The upper portion 12 may house one or more antennas (not illustrated) disposed on a pivotable mechanism (not illustrated). The one or more antennas and pivotable mechanism are permanently retained inside of an exterior wall of the upper portion 12 for protection from the exterior environment surrounding the decoy vehicle 10. The one or more antennas housed within the upper portion 12 are not the subject of this present disclosure.

The decoy vehicle 10 illustrated in FIG. 1 also includes first and second connecting members 18, 20. The first connecting member 18 engages the upper portion 12 and the middle portion 16 with one another. The second connecting member 20 engages the lower portion 14 and the middle portion 16 to one another.

As illustrated in FIG. 1, the decoy vehicle 10 also includes first and second propellers 24, 26. The first propeller 24 is disposed between the upper portion 12 and the middle portion 16 and is provided along a portion of the first connecting member 18. The second propeller 26 is disposed between the lower portion 14 and the middle portion 16 and is provided along a portion of the second connecting member 20. Each of the first and second propellers 24, 26 extends along an axis that is perpendicular to the longitudinal axis "Y" of the decoy vehicle 10. First and second propellers 24, 26 may also be arranged generally parallel to one another on the decoy vehicle 10. Each of the first and second propellers 24, 26 is powered and controlled by a motor or a propulsion system (not shown) provided on the decoy vehicle 10 (e.g., housed in the upper portion 12, the lower portion 14, or the middle portion 16). In the illustrated embodiment, a portion on each of the first and second connecting members 18, 20 is substantially cylindrical and configured to allow each of the first and second propellers 24, 26 to rotate about the longitudinal axis "Y" of decoy vehicle 10 when the decoy vehicle is airborne and in use. While the decoy vehicle 10 is airborne, each of the first and second propellers 24, 26 provides thrust to enable the decoy vehicle 10 to hover at a predetermined location a distance from a naval vessel or other asset to be protected, and to hover for a predetermined amount of time. The middle portion 16 of decoy vehicle 10 may house a motor and/or propulsion system (not illustrated) that powers first and second propellers 24, 26 and enables the same to be deployed and operated while decoy vehicle 10 hovers in the sky. It will be understood that the motor and/or propulsion system may be provided in any suitable location on decoy vehicle 10.

It will be understood that in other embodiments only one propeller may be provided or more than two propellers may be provided on decoy vehicle 10. Additionally, other configurations of the first and second connecting members 18, 20 than illustrated in FIG. 1 are possible. Furthermore, it should be understood that in yet other embodiments the propellers may be omitted completely and another mechanism may be provided to allow decoy vehicle 10 to hover in the sky.

The lower portion 14 of the decoy vehicle 10 has an exterior top wall 28, bottom wall 29, and circumferential wall 32 that extends between top wall 28 and bottom wall 29. The top wall 28, bottom wall 29, and circumferential wall 32 bound and define an interior chamber 30. The lower portion 14 also defines an opening 34 in the circumferential wall 30 which extends from an exterior surface 33 of circumferential wall 32 to an interior surface 35 thereof. The opening 34 allows the chamber 30 to be selectively placed in communication with the exterior environment surrounding the decoy vehicle 10.

Figure 2:
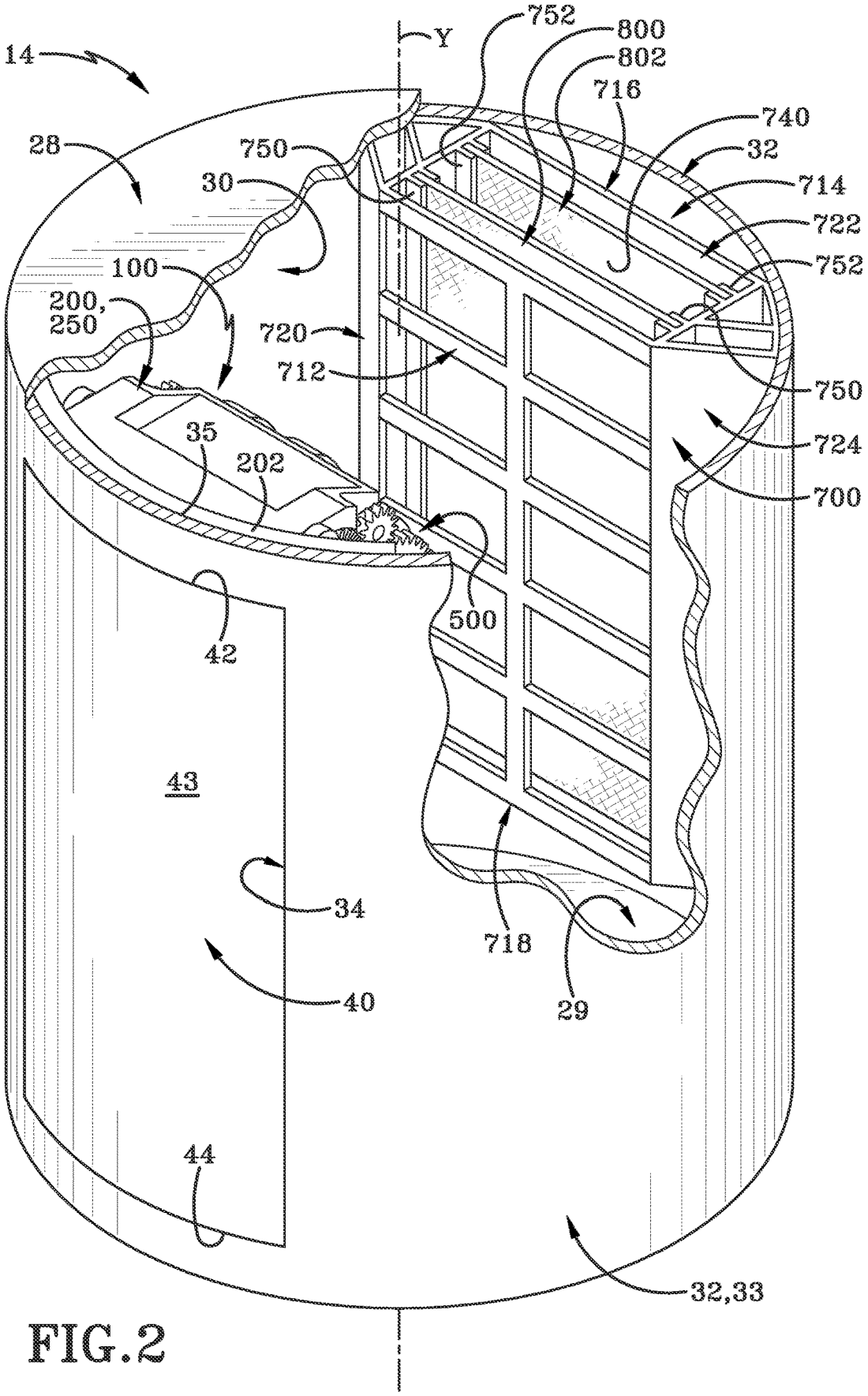
FIG. 2 illustrates a top isometric perspective view of a lower portion of the decoy vehicle of FIG. 1 with a part of the top wall of the lower portion removed and showing the antenna positioner and a chassis in accordance with the present disclosure located within a chamber defined in the decoy vehicle.

As illustrated in FIGS. 1 and 2, a cover 40 is disposed over the opening 34 defined in the exterior circumferential wall 32 of the lower portion 14. The cover 40 is provided to selectively close off access to the opening 34 and thereby between chamber 30 and the exterior environment surrounding decoy vehicle 10. Cover 40 is engaged with the exterior circumferential wall 32 in such a way that it remains engaged with wall 32 during launch of decoy vehicle 10 and while decoy vehicle 10 is initially hovering in the sky. When required, cover 40 is able to be disengaged from wall 32 in order to reveal opening 34.

Referring still to FIGS. 1 and 2, the cover 40 includes a top end 42, a bottom end 44, an outer surface 43 that extends from the top end 42 to the bottom end 44, and an inner surface 45 that extends from the top end 42 to the bottom end 44. The outer and inner surfaces 43, 45 are arranged generally parallel to one another and oppose each other. The outer surface 43 of the cover 40 faces away from circumferential wall 32 the decoy vehicle 10 and interacts with the exterior environment surrounding the decoy vehicle 10. The inner surface 45 of cover 40 faces into the chamber 30 defined in the lower portion 14. The cover includes first and second sets of attachment legs 46, 47 (FIG. 5A) that extend inwardly from the inner surface 45 of the cover 40 and towards an interior region of the chamber 30. The first set of attachment legs 46 is disposed parallel to the second set of attachment legs 47. The first set of attachment legs 46 is provided toward a right side region of the cover 40 while the second set of attachment legs 47 is provided towards a left side region of the cover 40. The cover 40 may include first and second extensions (not illustrated) which project upwardly from the inner surface 45 of cover 40 and beyond the top end 42 thereof. These first and second extensions may be oriented generally parallel to one another and be laterally spaced apart from one another. The purpose of the first and second extensions, if provided, will be described later herein.

Cover 40 may be fabricated from any suitable material. One suitable material is plastic material.

As illustrated in FIGS. 2-8, decoy vehicle 10 is provided with an antenna positioner 100 that is operable to greatly improve the decoy vehicle's near-vertical FoV relative to previously known decoy vehicles. As illustrated, the antenna positioner 100 and at least some of the associated components for operation thereof are provided in the lower portion 14 of decoy vehicle 10. Antenna positioner 100 and some of the associated components for operation of the same are located within chamber 30. It will be understood that other components that are not particularly relevant to the antenna positioner 100 and its operation have been omitted from FIGS. 2-8 for clarity of illustration only. Antenna positioner 100 is located within chamber 30 adjacent the opening 34 in the exterior circumferential wall 32. When antenna positioner 100 is in a collapsed position (FIGS. 2 and 3), antenna positioner 100 is protected by cover 40 which extends across the opening 34. Cover 40 remains in place during launch of decoy vehicle 10 and during initial hovering of the decoy vehicle 10. When antenna positioner 100 is to be actuated for use, cover 40 is ejected from lower portion 14 so that antenna position 100 is able to be deployed. Antenna positioner 100 is moved between a stowed, collapsed position (FIGS. 2 and 3) to a deployed, extended position (FIGS. 7 and 8) where at least a part of the antenna positioner 100 extends out of chamber 30 through opening 34 and outwardly beyond the exterior surface 33 of wall 32. In this deployed, extended position, antenna positioner 100 is able to be adjusted to view and capture an improved near-vertical FoV relative to antenna arrays provided on previously known decoy vehicles. All of these components and the operation thereof will be described in greater detail hereafter.

Figure 3:
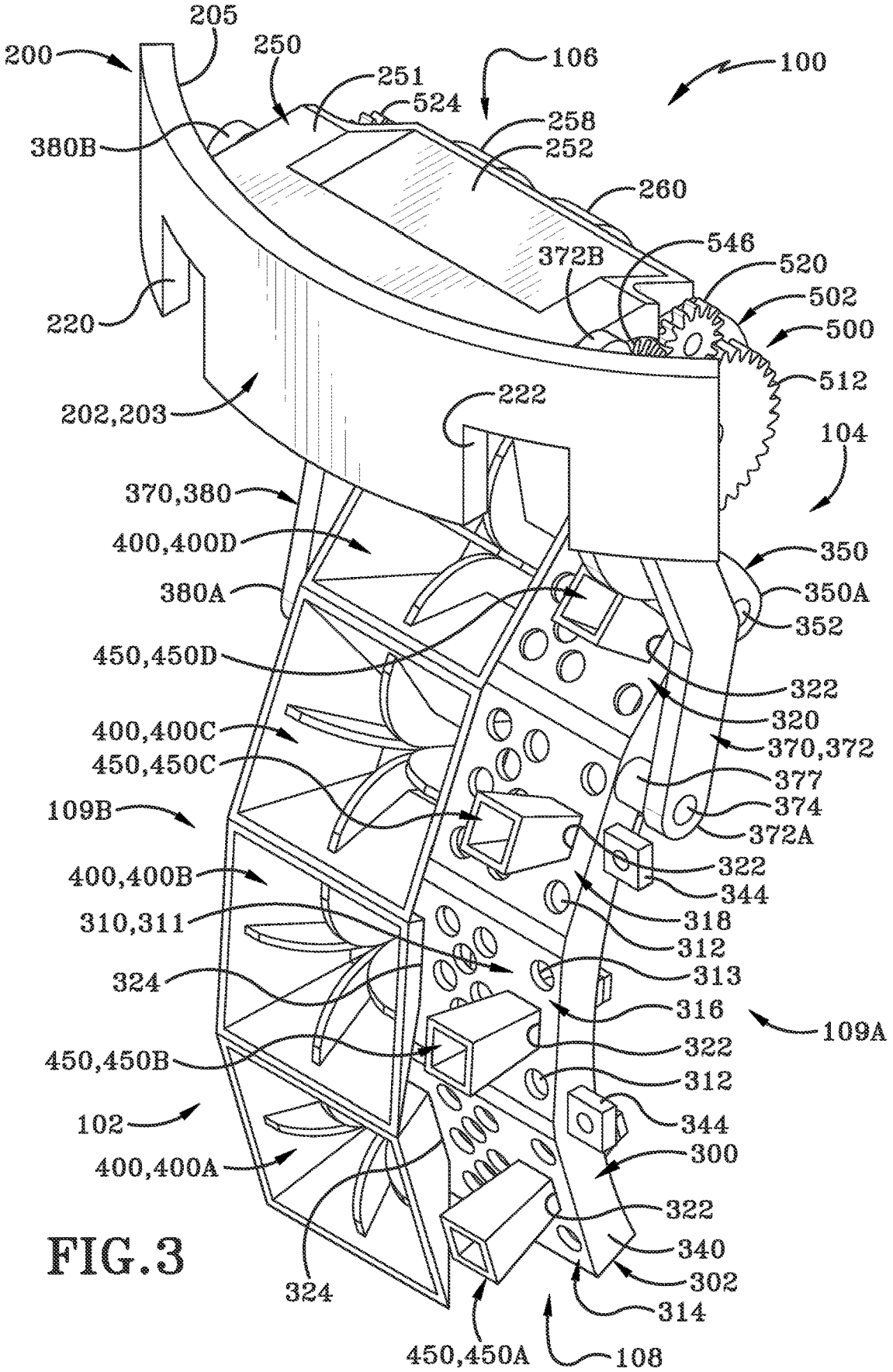
FIG. 3 illustrates a top isometric perspective view of the antenna positioner shown in isolation and depicted in a collapsed position.

Referring to FIGS. 3-8, antenna positioner 100 will now be described in greater detail. As best seen in FIG. 3, the antenna positioner 100 includes a base 200, a frame 300, a stabilizer mechanism 370, and at least one antenna provided on the frame 300. FIG. 3 illustrates an embodiment where the at least one antenna comprises a first set of antennas 400 and a second set of antennas 450 arranged on frame 300. Antenna positioner 100 further includes a gearing mechanism 500 that is operable to move the frame 300 and antennas 400, 450 provided thereon between the collapsed position and the extended position as will be described in detail hereafter.

As illustrated in FIG. 3, the antenna positioner 100 defines a front end 102 and a rear end 104 that opposed to the front end 102, a top end 106 and a bottom end 108 that opposite to the top end 106. The front end 102 of antenna positioner 100 faces outwardly toward the opening 34 defined in exterior wall 32 and thereby towards interior surface 45 of cover 40. Top end 106 faces an underside of top wall 28 of lower housing 14, and bottom end 108 of antenna positioner 100 is located closest to a bottom end 29 of decoy vehicle 10. The antenna positioner 100 defines a longitudinal axis that extends from top end 106 to the bottom end 108 thereof and this antenna positioner longitudinal axis is arranged parallel to the longitudinal axis "Y" of the decoy vehicle 10.

Figure 4:
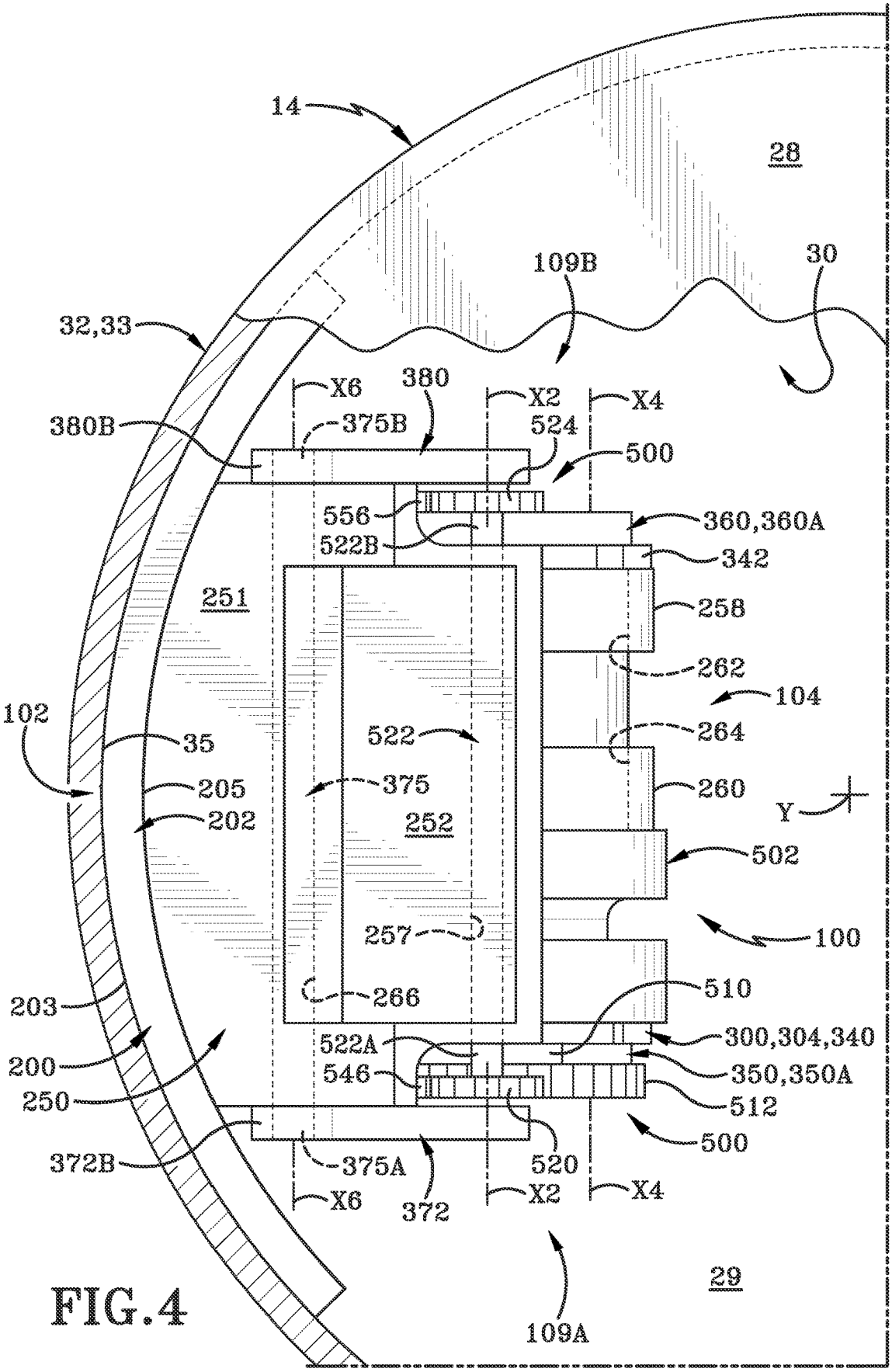
FIG. 4 illustrates a top plan view of the antenna positioner of FIG. 3 shown proximate a cross-section of a portion of lower housing of the decoy vehicle.
Figure 5A:
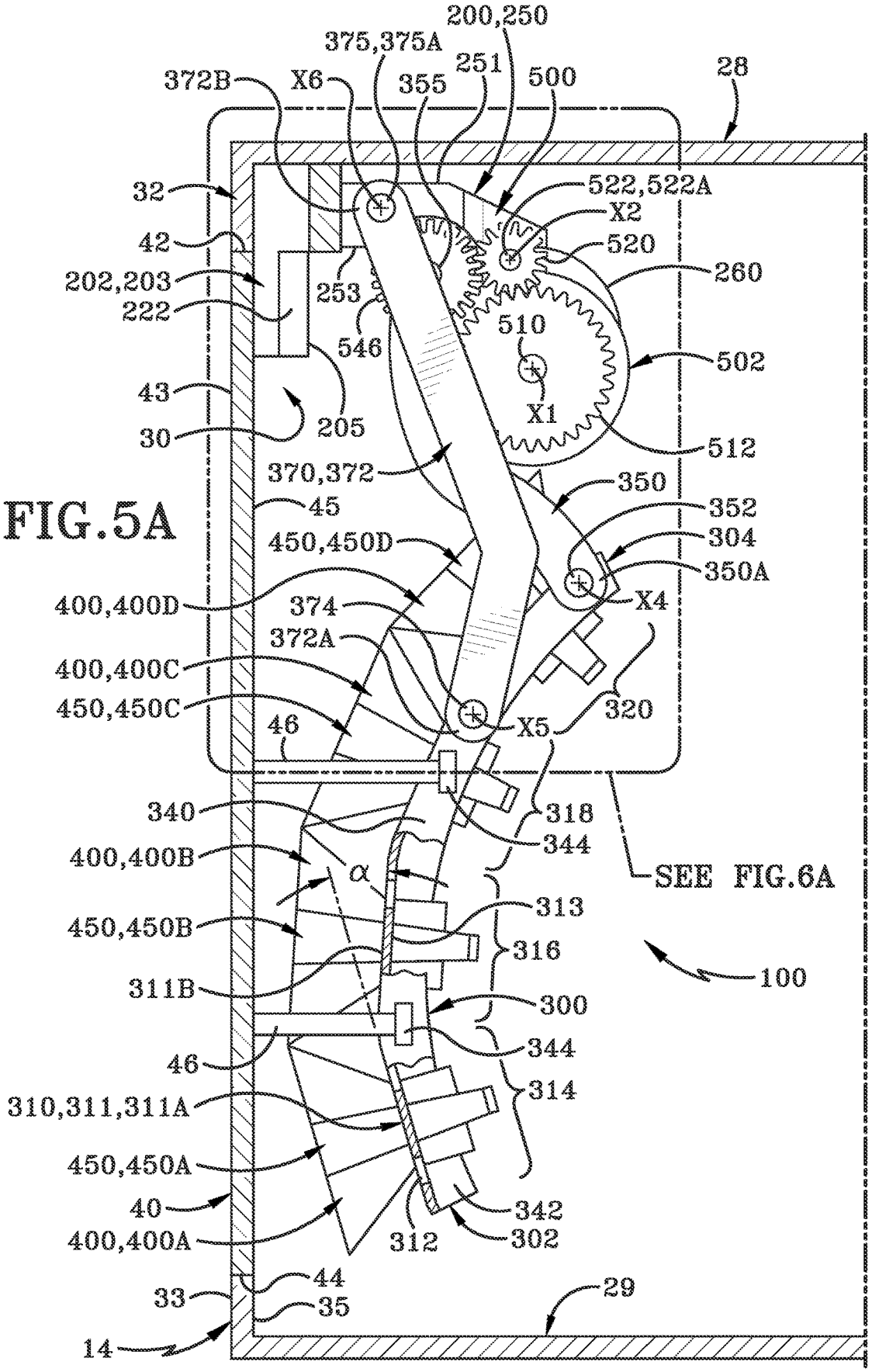
FIG. 5A illustrates a right side elevation view of the antenna positioner shown proximate a partial cross-section of the lower portion of the decoy vehicle. The antenna positioner is shown in the collapsed position.

As illustrated in FIGS. 2 and 5A, the base 200 is operatively engaged with the top end 106 of the antenna positioner 100 and extends between the front and rear ends 102, 104 of the antenna positioner 100. Base 200 includes a mounting plate 202 for mechanically attaching the antenna positioner 100 to a region of lower portion 14. The mounting plate 202 includes a mounting plate front surface 203 and a mounting plate rear surface 205. As illustrated in FIGS. 2 and 4, the mounting plate 202 mechanically attaches the antenna positioner 100 to circumferential wall 32 of lower portion 14. Mounting plate front surface 203 directly interfaces with the interior surface 35 of the wall 32 inside of the chamber 30. Mounting plate front surface 203 has a shape that is complementary to the interior surface 35 of the wall 32 and enables a suitable mechanical attachment between the base 200 and the decoy vehicle 10. In the illustrated embodiment, the mounting plate 202 defines a curvilinear shape that is complementary to the curvilinear shape of interior surface 35 the wall 32 of the lower portion 14.

The base 200 of the antenna positioner 100 provides a cantilever structure to attach and suspend each of the frame 300, the first set of antennas 400, the second set of antennas 450, the stabilizer mechanism 370, and the gearing mechanism 500 within the chamber 30 of decoy vehicle 10. The cantilever structure of the base 200 is considered advantageous at least because each of the frame 300, the first set of antennas 400, the second set of antennas 450, the stabilizer mechanism 370, and the gearing mechanism 500 is compactly contained within the chamber 30 with minimal attachment points between the base 200 and the wall 32 of the decoy vehicle 10. Furthermore, the cantilever structure of the base 200 allows for full articulation of the frame 300 between the collapsed position and the extended position. The articulation of frame 300 will be described in more detail later herein.

It will be understood that any suitable method for mechanically attaching mounting plate 202 of base 200 to wall 32 of lower portion 14 may be utilized. For example, the mounting plate front surface 203 may be secured to the lower portion 14 with fasteners such as rivets or screws, by welding, with an adhesive, by snap fitting or press-fitting complementary components on the two surfaces to one another. In other embodiments, mounting plate 202 or other parts of base 200 may be integrally molded as part of lower portion 14.

As illustrated in FIG. 3, the mounting plate front surface 203 defines first and second slots 220, 222. Each of the first and second slots 220, 222 originates in a bottom end of the mounting plate front surface 203 and extends upwardly therefrom towards a top end of the mounting plate front surface 203. First and second slots 220, 222 terminate a distance from the top end of the mounting plate front surface 203. The first and second slots 220, 222 extend between a front surface and a rear surface of the mounting plate front surface 203, are generally parallel to one another, and are spaced laterally a distance from one another. As discussed earlier herein, the cover 40 may be provided with a first extension and a second extension (not shown) which project inwardly and upwardly from the cover's inner surface. These first and second extensions may be configured to be interlockingly received within the first and second slots 220, 222 of base 200 in order to aid in engaging cover 40 to frame 300. The provision of the first and second slots 220, 222 in the mounting plate 202 is considered advantageous at least because the first and second slots 220, 222 provide locations for the cover 40 to attach to the antenna positioner 100 in such a way that the cover 40 protects the antenna positioner 100 during launch of the decoy vehicle 10.

Referring to FIGS. 3-6, the base 200 of antenna positioner 100 also includes a hanger 250 having a hanger top surface 251 and a hanger bottom surface 253. As shown in FIG. 4, the hanger 250 extends inwardly from the mounting plate 202, specifically from the mounting plate rear surface 205, towards the antenna positioner rear end 104. In the illustrated embodiment, the mounting plate 202 and the hanger 250 are integrally formed with one another but in other embodiments, the mounting plate and hanger may be operatively engaged with one another. The hanger 250 defines a recess 252 therein that extends from hanger top surface 251 downwardly towards the hanger bottom surface 253 and terminates at a medial location within the hanger 250.

Figure 6A:
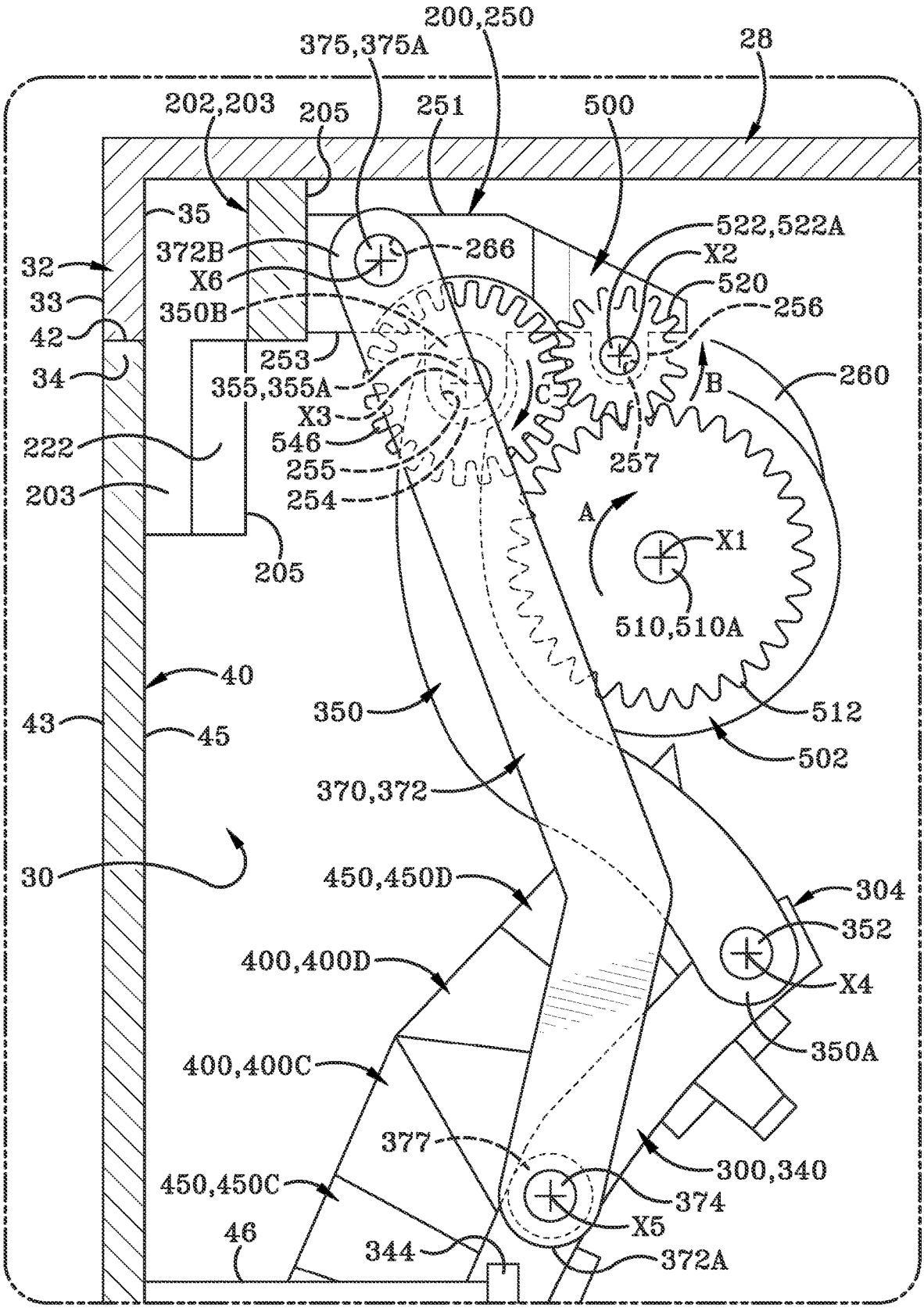
FIG. 6A illustrates an enlargement of the highlighted region of FIG. 5A.
Figure 6B:
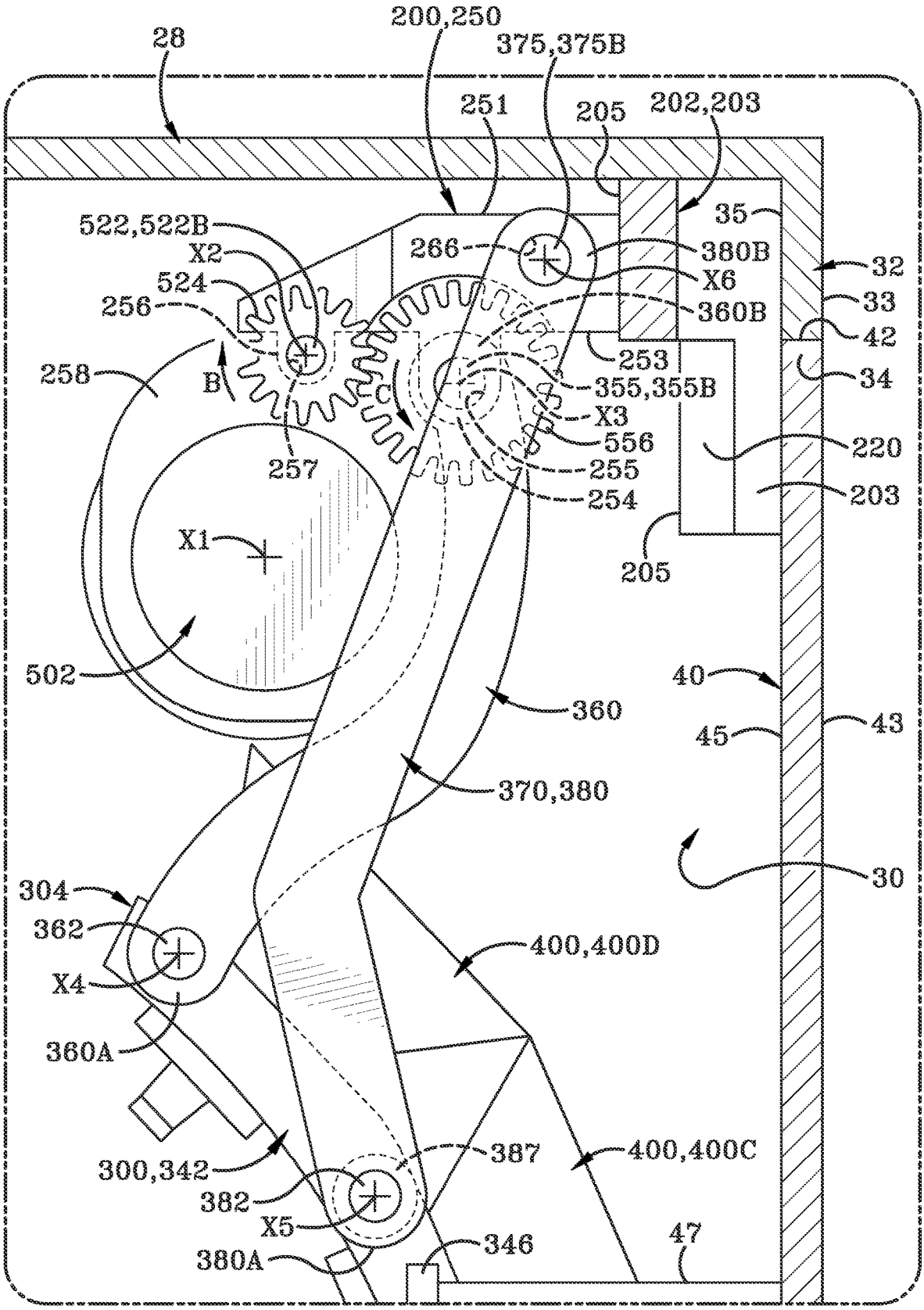
FIG. 6B illustrates an enlargement of the highlighted region of FIG. 5B.

As illustrated in FIGS. 6A and 6B, the hanger 250 includes a first shaft mount 254 that defines a first passageway 255, a second shaft mount 256 that defines a second passageway 257, and a third shaft mount 266 that defines a third passageway 267. The first shaft mount 254 extends downwardly from the bottom surface 253 of the hanger 250 towards the bottom end 108 of the antenna positioner 100. Similarly, the second shaft mount 256 extends downwardly from the bottom surface 253 of the hanger 250 towards the bottom end 108 of the antenna positioner 100. The first shaft mount 254 is disposed between the front end 102 and the rear end 104 of the antenna positioner 100 and is disposed along a medial portion of the antenna positioner 100. The second shaft mount 256 is disposed between the first shaft mount 254 and the rear end 104 of the antenna positioner 100 and is disposed closer to the rear end 104 of the antenna positioner 100. The third shaft mount 253 is disposed between the front end 102 of the antenna positioner 100 and the first shaft mount 254 and is disposed closer to the front end 102 of the antenna positioner 100.

The hanger 250 also includes first and second motor mounts 258, 260 (FIGS. 4, 6A and 6B). Each of the first and second motor mounts 258, 260 is disposed on the hanger bottom surface 253 and extends downwardly from the bottom surface 253 of the hanger 250 and towards the bottom end 106 of the antenna positioner 100. As illustrated in FIG. 4, the first motor mount 258 is disposed between the first and second sides 109A, 109B of the antenna positioner 100 and is disposed closer to the first side 109A of the antenna positioner 100. The second motor mount 260 is disposed between the first motor mount 258 and the second side 109B of the antenna positioner 100 and is disposed closer to the second side 109B of the antenna positioner 100. Each of the first and second motor mounts 258, 260 also defines first opening 262 and a second openings 264 therein.

FIGS. 3 and 5A through 7 illustrate the frame 300 of the antenna positioner 100. The frame 300 has a frame first end 302 and a frame second end 304 that directly opposes the frame first end 302 and first and second sides (not numbered) that extend between frame first end 302 and frame second end 304. The frame 300 includes a plate 310 which extends from the frame first end 302 to the frame second end 304. The plate 310 has a plate top surface 311 and an opposed plate bottom surface 313. The plate 300 defines a plurality of apertures 312 therein where apertures 312 are provided at intervals along plate 300. Each aperture 312 of the plurality of apertures extends from the plate top surface 311 to the plate bottom surface 313 such that the plate's top and bottoms surfaces 311, 313 are in communication with one another. The plurality of apertures 312 help to decrease the overall weight of the frame 300 and allow air to flow therethrough as the frame 300 is manipulated (as will be described later herein), thus reducing air resistance on frame 300 as it is deployed, i.e., moved to the extended position.

As illustrated in FIG. 5, the plate 310 comprises a first plate portion 314, a second plate portion 316, a third plate portion 318, and a fourth plate portion 320. The first plate portion 314 is disposed at the frame first end 302 and extends towards the frame second end 304. The second plate portion 316 is disposed between the frame first and second ends 302, 304 such that the first plate portion 314 is interposed between second plate portion 316 and frame first end 302. The second plate portion 316 is located adjacent to first plate portion 314 along an axis extending between the frame first end 302 and the frame second end 304. First plate portion 314 and second plate portion 316 are engaged with one another. The third plate portion 318 extends outwardly from second plate portion 316 towards frame second end 304 and such that second plate portion 316 is interposed between first plate portion 314 and third plate portion 318. The third plate portion 318 is adjacent to second plate portion 316 along the axis extending between the frame first end 302 and the frame second end 304. Third plate portion 318 is engaged with second plate portion 316. The fourth plate portion 320 is disposed at the frame second end 304 such that third plate portion 318 is interposed between second plate portion 316 and fourth plate portion 320. The fourth plate portion 320 is adjacent to third plate portion 318 along the axis extending between the frame first end 302 and the frame second end 304, and is operatively engaged with the third plate portion 320. In the illustrated embodiment, the first, second, third, and fourth plate portions 314, 316, 318, 320 are substantially continuous with one another in such a way that first, second, third, and fourth plate portions 314, 316, 318, 320 are integrally formed and together collectively define the plate 310.

The first, second, third, and fourth portions 314, 316, 318, 320 of the plate 310 may be disposed at an angle relative to one another. The first, second, third, and fourth portions 314, 316, 318, 320 of plate 310 may be disposed at a same fixed angle relative to one another. Examples of suitable angles for first, second, third, and fourth portions of a plate to be disposed relative to one another include any angle from about 0 degrees up to about 90 degrees. In other embodiments, the first, second, third and fourth portions 314, 316, 318, 320 of plate 310 may be disposed at different angles relative to one another. For example, first portion 314 may be disposed at a first angle of from about 0 degrees up to about 90 degrees relative to second portion 314, and second portion may be disposed at a different second angle of from about 0 degrees up to about 90 degrees relative to third portion 316, and so on. As best seen in FIGS. 3 and 5A, adjacent plate portions of the first, second, third, and fourth plate portions 314, 316, 318, 320 are disposed at the same fixed angle relative to each other. By way of example only, this same fixed angle is about 20 degrees. For example, as illustrated in FIG. 5A, the first plate portion 314 includes a first upper surface 311A and the second plate portion 316 includes a second upper surface 311B. As illustrated, the second upper surface 311B of the second plate portion 314 is oriented an angle $\alpha$ relative to the first upper surface 311A of the first plate portion 311A. The angle $\alpha$ between the second upper surface 311B of the second plate portion 314 and the first upper surface 311A of the first plate portion 311A is about 20 degrees. Similarly, an upper surface of the third plate portion 318 is oriented at an angle $\alpha$, relative to the second upper surface 311B of the second plate portion 314. Similarly, an upper surface of the fourth plate portion 320 is oriented at an angle $\alpha$, relative to the upper surface of the third plate portion 318. As such, the third plate portion 318 is disposed at about 20 degrees relative to the second plate portion 316, and the fourth plate portion 320 is disposed at about 20 degrees relative to the third plate portion 318. It should be noted that the specific angle $\alpha$ selected may be based on the particular application of decoy vehicle 10.

As indicated above, it will be understood that in other embodiments, the plate portions 314, 316, 318, and 320 may be disposed at a different angle relative to one other instead of at a same angle to one another. For example, the first portion of the plate may be disposed at 20 degrees relative to the second portion of the plate, the second portion of the plate may be disposed at 25 degrees relative to the third portion of the plate, and the third portion of the plate may be disposed at 22 degrees relative to the fourth portion of the plate. It should be noted that the specific different angles selected may be based on the particular application of decoy vehicle 10.

The configuration of the first, second, third, and fourth plate portions 314, 316, 318, 320 of the plate 310 collectively define a curvilinear shape along the frame 300 between the frame first end 302 to the frame second end 304. The curvilinear shape of the frame 300 is considered advantageous at least because the curvilinear shape allows the first and second sets of antennas 400, 450 to view and capture slightly different FoVs relative to one another and this aids the antenna positioner to capture a greatly improved near-vertical FoV about the decoy vehicle 10 during use, which is described in more detail below.

The plate 310 of frame 300 also defines a first set of openings 322 and a second set of openings 324. The first and second sets of openings 322, 324 extends entirely through the plate 310 from the plate top surface 311 to the plate bottom surface 313. At least one opening of the first set of openings 322 and at least one opening of the second set of openings 324 is defined in each of the first, second, third, and fourth plate portions 314, 316, 318, 320. In one exemplary embodiment, each of the first and second sets of openings 322, 324 includes one opening on each of the first, second, third, and fourth plate portions 314, 316, 318, 320 such that each plate portion defines two laterally-spaced apart openings 322, 324 and the plate 310 defines eight openings altogether. The eight openings include a first row of four first openings 322 and a second row of four second openings 324. The openings 322 in the first row are aligned with one another. Similarly, the openings 324 in the second row are aligned with one another. The first row and the second row of openings are laterally spaced from one another on plate 310. The openings 322 and 324 on each of the first plate portion 314 may be laterally aligned with one another. Similarly, the openings 322, 324 on each of the second plate portion 316, third plate portion 318, and fourth plate portion 320 may be laterally aligned with each other. Additionally, the openings of the first set of openings 322 on the four plates 314, 316, 318, 320 are longitudinally aligned with one another along plate 310 and are longitudinally spaced a distance apart from each other along plate 310. Furthermore, the openings of the second set of openings 324 are longitudinally aligned with one another along plate 310 and are longitudinally spaced apart from each other along plate 310. Each of the first set of openings 322 is sized and configured to receive and house one antenna 400 of the first set of antennas 400 therein. Additionally, each opening of the second set of openings 324 is sized and configured to receive one and house one antenna 450 of the second set of antennas 450 therein.

While the first, second, third, and fourth plate portions 314, 316, 318, 320 are disclosed as remaining stationary relative to one another and are integrally engaged with one another to collectively define the frame 300, in other embodiments the plate portions may be configured so as to move relative to one another. For example, the plate portions in other embodiments may be configured to articulate (i.e., pivot or move) relative to one another and may be selectively maneuvered to be disposed at different angles relative to one another. In an exemplary embodiment (not shown herein), one portion of the frame, such as the first plate portion, may force the remaining portions of the frame, such as the second, third, and fourth plate portions, to articulate based on the movement and angle defined by the first plate portion. In other words, the remaining plate portions of the frame may be mechanically linked to the first plate portion such that the movement and angle of the first plate portion determines the movement and angle of the remaining plate portions.

Referring still to FIGS. 3-8, the frame 300 further includes first and second lateral walls 340, 342 which extend from the frame first end 302 to the frame second end 304. The first and second lateral walls 340, 342 are spaced laterally apart and are arranged parallel to one another. Each of the first and second lateral walls 340, 342 is operatively engaged with the plate 310. In one exemplary embodiment, first and second lateral walls attach to a plate bottom surface and extend downwardly away from the plate bottom surface.

In another exemplary embodiment, a first lateral wall attaches to lateral edge on a plate and a second lateral wall attaches to an opposing lateral edge on a plate where each of the first and second lateral walls extends downwardly away from the plate. In another exemplary embodiment, first and second lateral walls are integrally formed with the first, second, third, and fourth plate portions 314, 316, 318, 3210 such that the first and second lateral walls and the plate form a unitary, monolithic structure. Each of the first and second lateral walls 340, 342 defines a curvilinear shape that is complementary to the curvilinear shape collectively defined by the first, second, third, and fourth plate portions 314, 316, 318, 320 of the plate 310. As such, each of the first and second lateral walls 340, 342 may define any suitable shape that complements the shape of the plate 310 of the frame 300.

The first lateral wall 340 on plate 310 is provided with a first set of attachment posts 344. Each attachment post of the first set of attachment posts 344 extends laterally away from an outer lateral surface of the first lateral wall 340. Each attachment post of the first set of attachment posts 344 is oriented generally at right angles relative to the outer lateral surface of the first lateral wall 340. Similarly, the second lateral wall 342 includes a second set of attachment posts 346. Each attachment post of the second set of attachment posts 346 is engaged with an outer lateral surface of the second lateral wall 342 and extends laterally away from the outer lateral surface of the second lateral wall 342. Each attachment post of the second set of attachment posts 346 is oriented generally at right angle relative to the outer lateral surface of the second lateral wall 342. The first set of attachment posts 344 and second sets of attachment posts are arranged parallel to each other, are aligned in laterally spaced apart pairs and are diametrically opposed to one another each other on the frame 300. For example, a post 344A of the first set of attachment posts 344 is laterally aligned with a post 346A of the second set of attachment posts 346. The configuration of the first set of attachment posts 344 and second sets of attachment posts 346 on the first and second lateral walls 340, 342 is considered advantageous at least because the attachment posts 344, 346 provide locations to allow the cover 40 to operably engage the frame 300. The first and second sets of attachment legs 46, 47, respectively, operably engage the first set of attachment posts 344 and second set of attachment posts 346 on the frame 300. The first and second sets of attachment legs 46, 47 and first and second sets of attachment posts 344, 346 are operably engaged with one another when the antenna positioner 100 is in the collapsed position (FIGS. 2 and 5A) and the frame 300 is located entirely within the chamber 30 of the lower portion 14.

When the frame 300 is actuated to move to the extended position, the frame 300 pivots outwardly from the chamber 30 and the first and second set of attachment posts 344, 346 exert a pushing force on the cover 40 via the first and second sets of attachment legs 46, 47. This pushing force in a direction moving away from the exterior surface 33 of circumferential wall 32 causes cover 40 to disengage from wall 32 and from frame 300. The disengagement of cover 40 from wall 32 of lower portion 14 of decoy vehicle 10 leaves the opening 34 unobstructed so that at least a portion of frame 300 may move therethrough as the antenna positioner 100 is deployed to a use position.

Referring still to FIGS. 3 to 8, frame 300 further includes a first frame arm 350 and a second frame arm 360. First frame arm 350 and second frame arm 360 secure plate 310 to base 200. First frame arm 350 and second frame arm 360 are substantially identical in configuration, each being very generally of an "S-shape" when antenna positioner 100 is viewed from the right side as in FIG. 6A. First frame arm 350 has a first end 350A that defines a first opening 352A therethrough and a second end 350B that defines a second opening 352B therethrough. The first end 352A of the first frame arm 350 is operably engaged with frame 300 along a portion of the first lateral wall 340 proximate second end 304 of the frame 300. The first opening 352A in first frame arm 350 is aligned with an opening (not shown) defined in first lateral wall 340 and a first fastener 354A is received through these aligned openings. The frame 300 includes a second frame arm 360 that is disposed opposite to the first frame arm 350. Similarly, the second frame arm 360 includes a first end 360A that defines a first opening 362A therethrough and a second end 360B which defines a second opening 362B therethrough. The first end 362A of the second frame arm 360 operably engages frame 300 along a portion of the second lateral wall 342 proximate second end 304 of the frame 300. The second lateral wall 342 defines an opening therein. The second frame arm 360 is engaged with frame 300 by engaging a first fastener 364A through the aligned first opening 362A and the opening in the second lateral wall 342. The first ends 350A, 360A of the first and second frame arms 350, 360 are thereby secured to top end 302 of frame 300. It will be understood that instead of an opening being defined in each of the first lateral wall 340 and second lateral wall 342, a single opening may extend from first lateral wall 340 to second lateral wall 342 and a single fastener in the form of a pivot rod may be inserted through first opening 350A, through the single opening in the top end 302 of frame 300, and through the first opening 360A in the second frame arm 360.

The second end 350B of the first frame arm 350 and the second end 360B of the second frame arm 360 are operably engaged with hanger 250 to secure frame 300 to hanger 250. In particular, second end 350B of first frame arm 350 is engaged with hanger 250 and second end 360B of second frame arm 360 is engaged with hanger 250 via first shaft mount 254. Such engagement between the first frame arm 350, second frame arm 360, and the hanger 250 is provided via a first shaft 355 being passed through the second hole 352B defined in the first frame arm 350, through first passageway 255 (FIG. 6A) of the first shaft mount 254 and through second hole 362B of second frame arm 360. As will be described later herein, a frame gear is provided on either end of the first shaft 355.

Figure 5B:
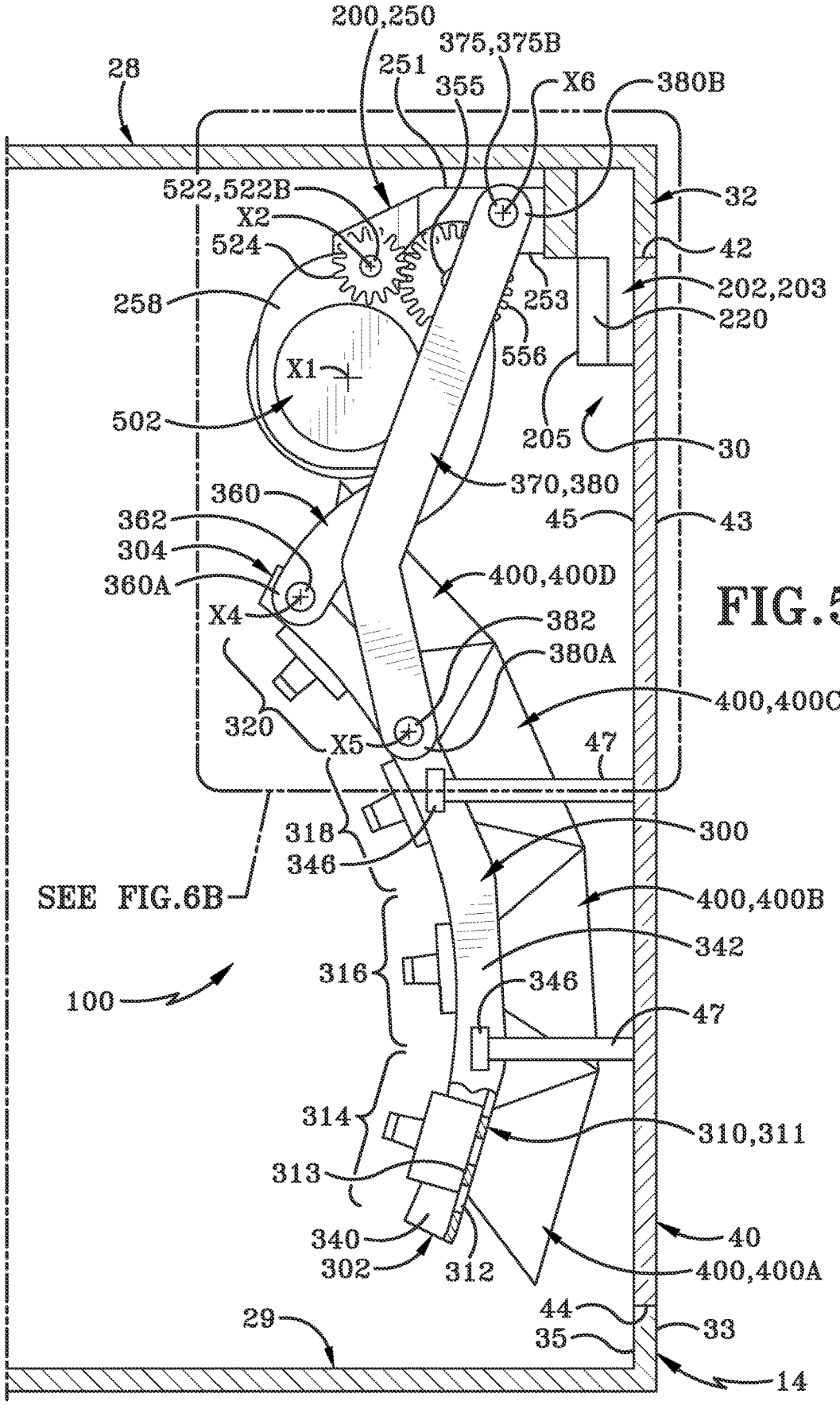
FIG. 5B illustrates a left side elevation view of the antenna positioner shown proximate a partial cross-section of the lower portion of the decoy vehicle. The antenna positioner is shown in the collapsed position.

Antenna positioner 100 also includes a stabilizer mechanism 370 comprising a first stabilizer 372 (FIG. 5A) and a second stabilizer 380 (FIG. 5B). First stabilizer 372 and second stabilizer 380 extend between base 200 and frame 300. As can be seen from FIG. 4, the second stabilizer 380 is disposed on an opposite side of frame 300 and base 200 relative to first stabilizer 372. Each of the first stabilizer 372 and second stabilizer 380 is generally "L-shaped" in that they are comprised of two sections that are arranged at an obtuse angle relative to one another. The first stabilizer 372 includes a first end 372A that defines a first opening therein and a second end 372B that defines a second opening therein. The second stabilizer 380 also includes a first end 380A that defines a first opening therein and a second end 380B that defines a second opening therein.

As best seen in FIG. 3, the first end 372A of the first stabilizer 372 is engaged with the first lateral wall 340 of frame 300. A first spacer 377 is interposed between the first end 372 of first stabilizer 372 and the first lateral wall 340. The first spacer 377 provides a distance between the first frame arm 350 and the first stabilizer 372 based on the length of the first spacer 377. A fastener 374 extends through the first opening in the first end 372A of the first stabilizer 372, through a bore of the first spacer 377 and into an aligned hole defined in first lateral wall 340. In another exemplary embodiment, the first spacer may be integrally formed with one or the other of the first stabilizer 372 and the first lateral wall 340 and project into a hole defined in the other of the first stabilizer and the first lateral wall 340.

In a similar fashion, a second spacer 387 (FIG. 6B) is positioned between first end 380A of second stabilizer 380 and second lateral wall 342 of frame 300. A second fastener 382 secures the second stabilizer 380 to second lateral wall 342 by being inserted through the first opening in the first end 380A of second stabilizer 380, through the bore of second spacer 387 and into a hole defined in second lateral wall 342. The second spacer 387 may, alternatively be integrally formed with one or the other of the second stabilizer 380 and the second lateral wall 342 and project into a hole defined in the other of the second stabilizer 380 and the second lateral wall 342. The second spacer 382 creates a distance between second frame arm 360 and the second stabilizer 380 based on the length of the second spacer 387.

The second end 372B of the first stabilizer 372 and the second end 380B of the second stabilizer 380 operably engage the hanger 250 at the third shaft mount 266. Such engagement between the first stabilizer 372, the second stabilizer 380, and the hanger 250 is provided via a second shaft 375 being passed through the second opening defined in the second end 372B of the first stabilizer 372, through the second passageway 266 defined in the hanger 250, and through the second opening defined in the second end 380B of the second stabilizer 380.

The first shaft 355 and second shaft 375 are spaced a distance away from each other with the second shaft 375 being located a distance vertically above and forwardly towards a front end 102 of the antenna positioner 100. First shaft 355 and second shaft 375 are oriented at right angles to longitudinal axis "Y" of decoy vehicle 10.

In the illustrated embodiment, the first frame arm 350 is disposed between the first stabilizer 372 and the frame 300 and base 200 near the second side 109B of the antenna positioner 100. Such positioning of the first stabilizer 372 relative to the first frame arm 350 is caused by the arrangement and configuration of the first spacer 377 and the third shaft mount 266. In addition, the second frame arm 360 is disposed between the second stabilizer 380 and the frame 300 and the base 200 near at the first side 109A of the antenna positioner 100. In another perspective, the second stabilizer 380 is disposed closer to the first side 109A of the antenna positioner 100 than the second frame arm 360. Such positioning of the second stabilizer 380 relative to the second frame arm 360 is caused by the arrangement and configuration of the second spacer 387 and the third shaft mount 266.

The first and second frame arms 350, 360 are considered advantageous at least because the first and second frame arms 350, 360 help to transfer the torque from the gearing mechanism 500 to the frame 300 to allow the frame 300 to pivot between the collapsed position and the expanded position relative to the base 200, which is described in more detail below. In addition, the first and second stabilizers 372, 380 are considered advantageous at least because the first and second stabilizers 372, 380 help to provide lateral support to the frame 300 when the frame 300 pivots between the collapsed position to the expanded position. In particular, the first and second stabilizers 372, 380 help to prevent lateral motion of frame 300 as frame is pivoted between the collapsed and extended positions. The first and second stabilizers 372, 380 also provide lateral support and rigidity to the frame 300 when the frame 300 is exposed to the exterior environment and surrounding elements (i.e., wind resistance, etc.)

While the illustrated embodiment provides first and second frame arms 350, 360 for pivoting the frame 300 of the antenna positioner 100, and first and second stabilizers 372, 380 for stabilizing frame 300, it will be understood that any suitable number of frame arms and stabilizers may extend between base 200 and frame 300. Example numbers of frame arms for pivoting a frame of an antenna positioner include one, at least one, a plurality, two, three, four, five, six, or any suitable number of frame arms may be utilized for pivoting a frame of an antenna positioner.

As illustrated in FIG. 3 and discussed earlier herein, the antenna positioner 100 includes first and second sets of antennas 400, 450 engaged within the first and second sets of openings 322, 324 defined along the plate 310 of the frame 300. A portion of each antenna 400 of the first set of antennas 400 is disposed within a respective opening 322 of the first set of openings 322 along the plate 310 of the frame 300. Part of the antenna 400 may be attached to a surface of the plate 310 bounding the associated opening 322. Similarly, a portion of each antenna 450 of the second set of antennas 450 is disposed within a respective opening 324 of the second set of openings 324 defined in plate 310 of the frame 300. Part of the antenna 450 may be attached to a surface of the plate 310 bounding the associated opening 324. Any suitable attachment method and/or technique may be used for operatively engaging the first and second sets of antennas 400, 450 with the plate 310 of the frame 300. Examples of suitable methods and/or techniques for attaching first and second sets of antennas to a plate of a frame include fastening, mounting, adhering, welding, press fitting, coupling, and any other suitable methods and/or techniques for attaching first and second sets of antennas to a plate of a frame.

Figure 7:
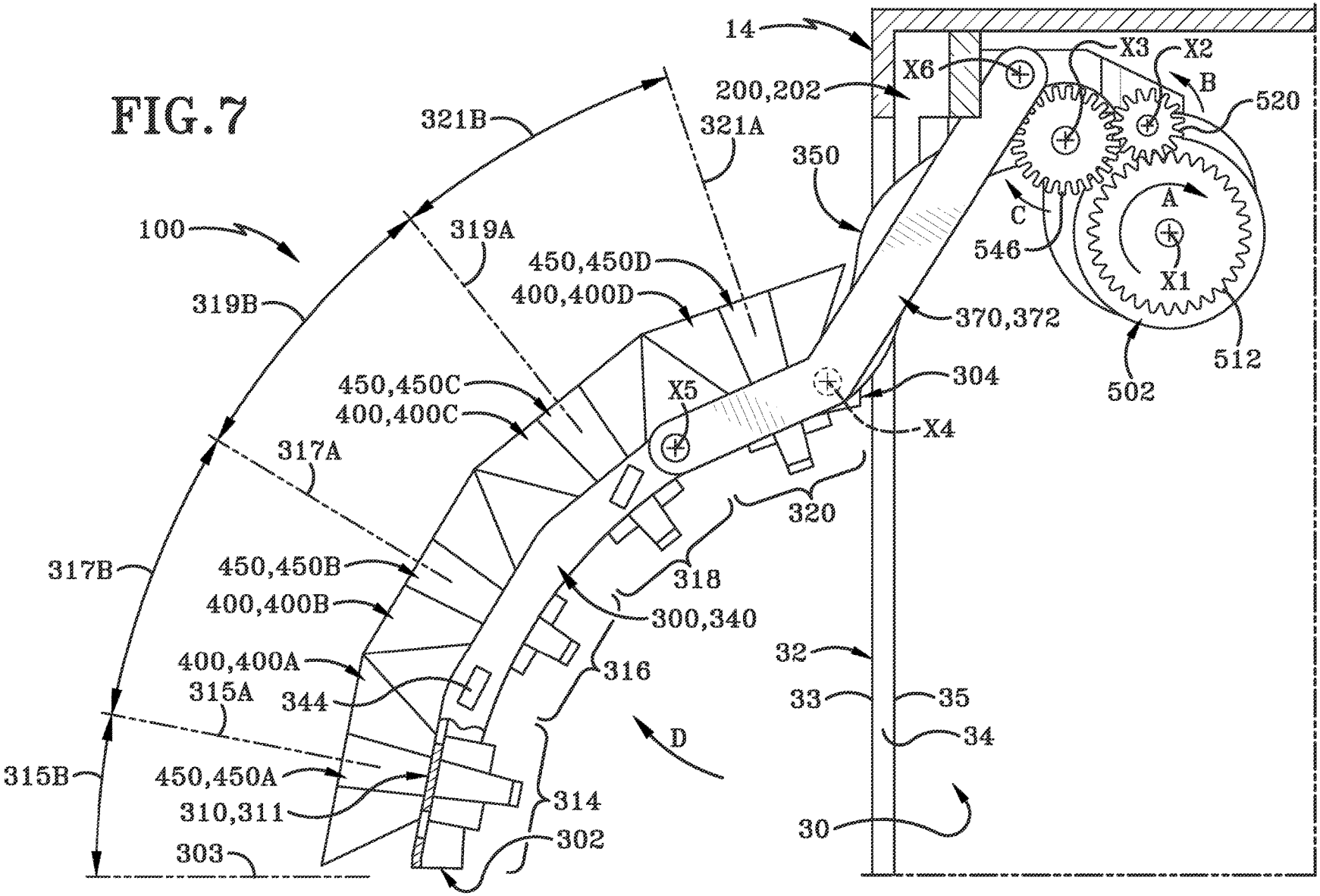
FIG. 7 illustrates a right side elevation view of the antenna positioner shown proximate a cross-section of part of the lower housing of the decoy vehicle; and wherein the antenna position is illustrated in an extended position where at least a portion of the antenna positioner extends out of the chamber through an opening defined in the exterior wall.

As illustrated in FIGS. 5A and 7, each antenna 400 of the first set of antennas 400 and each antenna 450 of the second set of antennas 450 is disposed generally perpendicular to the upper surface of the associated first, second, third, and fourth plate portions 314, 316, 318, 320. As such, each antenna of the first set of antennas 400 and each antenna of the second set of antennas 450 will be disposed at an angle $\alpha$ relative to the upper surface of the antennas 400, 450, respectively, of the adjacent first, second, third, and fourth plate portions 314, 316, 318, 320. As best seen in FIGS. 3 and 7, a first antenna 400A of the first set of antennas 400 is disposed on the first plate portion 314, a second antenna 400B of the first set of antennas 400 is disposed on the second plate portion 316, a third antenna 400C of the first set of antennas 400 is disposed on the third plate portion 318, and a fourth antenna 400D of the first set of antennas 400 is disposed on the fourth plate portion 320. Similarly, the second set of antennas 450 includes a first antenna 450A disposed on the first plate portion 314, a second antenna 450B disposed on the second plate portion 316, a third antenna 450C disposed on the third plate portion 318, and a fourth antenna 450D disposed on the fourth plate portion 320. The first antenna 400A and the first antenna 450A are disposed along a first axis 315A that is perpendicular to the upper surface 311A of first plate portion 314. The second antenna 400B and second antenna 450B are disposed along a second axis 317A that is perpendicular to the upper surface 311B of the second plate portion 316. The third antenna 400C and third antenna 450C are disposed along a third axis 319A that is perpendicular to the upper surface 311C of the third plate portion 318. The fourth antenna 400D and the third antenna 450C are disposed along a fourth axis 321A that is perpendicular to the upper surface 311D of the fourth plate portion 320.

As such, the first antenna 400A and the first antenna 450A will be oriented at an angle of about 20 degrees relative to second antenna 400B and second antenna 450B, respectively. Similarly, the second antenna 400B and second antenna 450B will be oriented at an angle of about 20 degrees relative the third antenna 400C and third antenna 450C, respectively. Still further, the third antenna 400C and third antenna 450C will be oriented at an angle of about 20 degrees relative to the fourth antenna 400D and fourth antenna 450D, respectively.

The arrangement of the first and second sets of antennas 400, 450 along the first, second, third, and fourth plate portions 314, 316, 318, 320 is considered advantageous at least because each antenna of the first and second sets of antennas 400, 450 may each view and capture the near-vertical FoV for objects and/or incoming threats at a different angle of altitude around the decoy vehicle 10. In other words, each antenna of the first and second sets of antennas 400, 450 will view and capture a slightly different range of altitudes base on their relative position on the plate 310. As illustrated in FIG. 7, the first antennas 400A, 450A on the first plate portion 314 are able to view and capture from about 0 degree to about 20 degrees of altitude measured relative to a plane 303 aligned with the bottom end 302 of the plate 310 when the antenna positioner 100 has moved to its extended position (which will be described later herein). The remaining pairs of antennas 400B, 450B; 400C, 450C; and 400D, 450D of the first and second sets of antennas 400, 450 that are disposed on the second, third, and fourth plate portions 316, 318, 320 are able to view and capture additional ranges of about 20 degrees of altitude relative to one another.

In accordance with an aspect of the disclosure, antenna positioner 100 includes a combination of low band antennas and high band antennas. As illustrated in FIG. 3, each antenna 400A, 400B, 400C, and 400D of the first set of antennas 400 is a low band antenna. Each antenna 450A, 450B, 450C, and 450D of the second set of antennas 450 is a high band antenna. In the illustrated embodiment, the first set of antennas 400 operate at first frequency and the second set of antennas 450 operate at a second frequency, where the first frequency is lower than second frequency. The first and second sets of antennas 400, 450 may also operate at different frequency ranges. In one exemplary embodiment, the first set of antennas 400 (i.e., low band antennas) may operate at a frequency range of from about 0.04 GHz up to about 0.20 GHz with a gain of from about 6 dBi up to about 15 dBi if the decoy vehicle 10 is moves to an orientation of about 10 degrees off vertical during its hovering state. The longitudinal axis "Y" of decoy vehicle 10 may move off vertical by force of wind acting on the vehicle, for example. In another exemplary embodiment, the second set of antennas 450 (i.e., high band antennas) may operate at a frequency range of from about 0.20 GHz up to about 0.40 GHz with a gain of from about 12 dBi up to about 15 dBi if the decoy vehicle 10 is moved about 10 degrees off vertical during its hovering state.

The first set of antennas 400 and the second set of antennas 450 are, essentially, frequency-agnostic. In other words, the first and second sets of antennas 400, 450 may utilize any suitable frequency based on a particular application of the antenna positioner 100 in which the first set of antennas 400 utilizes a lower frequency range than the second set of antennas 450 on the antenna positioner 100. For example, the first set of antennas 400 (i.e., low band antennas) may operate at a frequency range of from about 0.04 GHz up to about 0.20 GHz with a gain between 6 dBi to about 20 dBi if the longitudinal axis "Y" of decoy vehicle 10 is substantially vertically aligned during its hovering state. In another example, the second set of antennas 450 (i.e., high band antennas) may operate at a frequency range of from about 0.20 GHz up to about 0.40 GHz with a gain of from about 14 dBi up to about 21 dBi if the longitudinal axis "Y" of the decoy vehicle 10 is substantially vertically aligned during its hovering state. The combination of low band and high band antennas on the frame 300 is considered advantageous at least because the low and high band antennas 400, 450 allow for viewing and capturing the near-vertical FoV of the decoy vehicle 10 at different sensitivities and thereby maximize clarity of observing objects or incoming threats at different distances and altitudes relative to the decoy vehicle 10.

The antenna positioner 100, as illustrated, includes four low band antennas 400A, 400B, 400C, and 400D as the first set of antennas 400, and includes four high band antennas 450A, 450B, 450C, and 450D as the second set of antennas 450. In alternative embodiments, an antenna positioner may include any suitable desired number of antennas in the first set of antennas and any suitable desired number of antennas in the second set of antennas based on the size and configuration of the frame and the desired near-vertical FoV requirements for a particular application of a decoy vehicle. Examples of suitable numbers of antennas in each of first and second sets of antennas in an antenna positioner includes one, two, three, four, five, six, or any other desired number of antennas. Furthermore, in some embodiments, one or more, or all of the antennas may be low band antennas. In other embodiments, one or more, or all of the antennas may be high band antennas. In yet other embodiments one more additional antennas may be mid band antennas, i.e., operating at a frequency between the low band antennas and high band antennas. The particular one or more antennas selected for use on antenna positioner 100 will be based on the specific application of decoy vehicle 10.

As illustrated in the attached figures, each antenna of the first set of antennas 400 and the second set of antennas 450 is a horn antenna. In alternative embodiments, each antenna of a first set of antennas and the second set of antennas may comprise any other desired suitable type of antenna based on the size and configuration of the frame, and the particular application for use of the antennas. Examples of other types of antennas that may be used on antenna positioner 100 include but are not limited to patch antennas, spiral antennas, and dipole antennas.

FIGS. 4 through 6 illustrate the gearing mechanism 500 of the antenna positioner 100. The gearing mechanism 500 is operably connected to a motor 502 (FIG. 4) operably engaged with base 200. Motor 502 is sized and configured to be disposed through the first and second openings 262, 264 such that the motor 502 is housed inside the first and second motor mounts 258, 260. Motor 502 is actuated to enable the movement of gearing mechanism 500. Gearing mechanism 500 causes the frame 300 of the antenna positioner 100 to pivot between the collapsed position (FIGS. 5A and 5B) and the extended position (FIG. 7), which is described in more detail below. Motor 502 which interfaces with the gearing mechanism 500 and provides for articulation of the frame 300 in the antenna positioner 100 is illustrated as a single axis motor. As such, the motor 502 can only apply torque in a single axis of rotation. It will be understood that in other embodiments, a different motor or motors may be used to rotate frame 300.

The gearing mechanism 500 includes a driving gear 512 that meshes with a first continuation gear 520, and the first continuation gear 520, in turn, meshes with a first frame gear 546. As illustrated in FIG. 6A, the driving gear 512 is operably engaged with a first end 510A of a drive shaft 510 that extends outwardly from motor 502. As such, any movement and/or rotation of the drive shaft 510 by the motor 502, will be imparted to the driving gear 512. Drive shaft 510 and driving gear 512 will rotate in unison about the same first axis "X1".

The first continuation gear 520 is disposed vertically above the driving gear 512 within the antenna positioner 100 and meshes with the driving gear 512. Any force and/or rotation imparted to the driving gear 512 caused by the motor 502 will be imparted to the first continuation gear 520. During operation of the gearing mechanism 500, the driving gear 512 applies a rotational force to the first continuation gear 520 to rotate the first continuation gear 520 about a second axis of rotation "X2". The rotation of first continuation gear 520 about the axis "X2" will be in an opposite direction to the rotation of driving gear 512 about axis "X1".

First continuation gear 520 is operative engaged with continuation shaft 522. As illustrated in FIGS. 4 and 6A-6B, the continuation shaft 522 has a first end 522A and a second end 522B. The continuation shaft 522 extends through the second passageway 257 defined in the second shaft mount 256 of hanger 250 along the axis "X2". The first continuation gear 520 is fixed to the first end 522A of the continuation shaft 522, and a second continuation gear 524 (FIG. 6B) is fixed to the second end 522B of the continuation shaft 522. The second continuation gear 520 is arranged parallel to the first continuation gear 520 and is located on the first side 109A of antenna positioner 100. The provision of the continuation shaft 522 in the gearing mechanism 500 allows for any force and/or rotation imparted to the first continuation gear 520 to be transferred through the continuation shaft 522 to second continuation gear 524. The force and/or rotation of continuation shaft 522 is thus distributed generally equally to the first and second continuation gears 520, 524. The provision of the continuation shaft 522 and first and second continuation gears 520 524 is considered advantageous at least because a single motor, such as motor 502, may be used in conjunction with the gearing mechanism 500 to actuate the frame 300 at multiple locations.

Referring again to FIG. 6A, the first continuation gear 520 is also positioned to mesh with a first frame gear 546 of the gearing mechanism 500. The first frame gear 546 is disposed between the front end 102 of the antenna positioner 100 and the first continuation gear 520. In a similar arrangement, referring to FIG. 6B, the second continuation gear 524 is positioned to mesh with a second frame gear 556 located on the first side 109A of the antenna positioner 100. First frame gear 546 and second frame gear 556 are fixed to opposed ends of the first shaft 355 that extends through the first passageway 255 defined in hanger 250. As such, first frame gear 546, first shaft 355 and second frame gear 556 will rotate in unison.

As illustrated in FIGS. 5A, 5B and 6A, 6B, the second continuation gear 524 and the second frame gear 556 are opposed to the first continuation gear 520 and the first frame gear 546. The second continuation gear 524 is substantially similar to the first continuation gear 520 based on the size of each gear and the configuration of each gear. Similarly, the second frame gear 556 is substantially similar to the first frame gear 546 based on the size of each gear and the configuration of each gear, and with respect to the interaction with the respective frame arm 350, 360. In the illustrated embodiment, the configuration of the second continuation gear 524 and the second frame gear 556 mirror the configuration of the first continuation gear 520 and the first frame gear 546 and mirror the mechanical interaction between the first continuation gear 520 and the first frame gear 546

The first continuation gear 520 meshes with the first frame gear 546 to enable articulation of the frame 300. Any force and/or rotation imparted to first continuation gear 520 caused by the interaction of the driving gear 512 and the motor 502 will be, in turn, imparted to first frame gear 546. First frame gear 546 is caused to rotate about a third axis "X3" in response to rotation of first continuation gear 520. In particular, first frame gear 546 will rotate in an opposite direction to first continuation gear 520, and thereby in a same direction to driving gear 512. When first frame gear 546 is rotated about the third axis "X3", then the first shaft 355 and second frame gear 556 will also be cause to rotate about third axis "X3". First frame gear 546 is operatively engaged with the first frame arm 350 which, in turn, is engaged with frame 300. Second frame gear 556 is operatively engaged with second frame arm 360 which, in turn, is engaged with frame 300. During operation of the gearing mechanism 500, the first continuation gear 520 applies a rotational force to the first frame gear 546 to rotate the first frame gear 546 about the third axis of rotation "X3". Similarly, the second continuation gear 524 applies a rotation force to the second frame gear 556 to rotate the second frame gear 546 about the third axis of rotation "X3". The first and second continuation gears 520, 524 of the gearing mechanism 500, in essence, mechanically link the driving gear 512 to the first and second frame gears 546, 556 and thereby to first and second frame arms 350, 360. Any force and/or rotation imparted to the first and second frame gears 546, 556 will be imparted to the first and second frame arms 350, 360 and will cause the first and second frame arms 350 to pivot about the third axis "X3" and thereby move the frame 300 between the collapsed position and the extended position, which is described in more detail below.

The inclusion of the second continuation gear 524 and the second frame gear 556 in the gearing mechanism 500 is considered advantageous at least because the second continuation gear 524 and the second frame gear 556 provide an additional articulating mechanism that supplements the articulating mechanism of the first continuation gear 520 and the first frame gear 546 for articulating the frame 300 between the collapsed position to the extended position.

Referring now to FIG. 2, and has been briefly discussed earlier herein, lower portion 14 of decoy vehicle 10 houses a chassis 700 within chamber 30 of lower portion 14 of decoy vehicle 10. Chassis 700 is spaced rearwardly relative to the rear end 104 of antenna positioner 100 within the chamber 30. The chassis 700 includes a front end 712, a rear end 714 that opposes the front end 712, a top end 716, and a bottom end 718 that opposes the top end 716. The chassis 700 includes a first portion 720, a second portion 722 that is adjacent to the first portion 720, and a third portion 724 that is adjacent to the second portion 722. The second portion 722 of the chassis 700 is disposed between the first and third portions 720, 724.

The chassis 700 is provided proximate to the interior surface 35 of the wall 32 of the lower portion 14. The first and third portions 720, 724 attach the chassis 700 to the interior surface 35 of the wall 32 of the lower portion 14. The outer surfaces of each of the first and third portions 720, 724 defines a curvilinear shape that complements the curvilinear shape of the interior surface 35 of the wall 32 of the lower portion 14 and abuts the interior surface 35. The first and third portions 720, 724 may be utilized to attach the first and third portions 720, 724 to the wall 32. The second portion 722 of the chassis 700 does not directly contact the interior surface 35 of the wall 32. The second portion 722 defines a chassis chamber 740 that extends from the top end 716 of the chassis 700 to the bottom end of the chassis 700.

Chassis 700 is configured to receive a first circuitry card 800 and a second circuitry card 802. The chassis chamber 740 is sized and configured to house each of a first circuitry card 700 and a second circuitry card 802. In particular, the second portion 722 includes first and second sets of mounting brackets 750, 752 that extends into the chassis chamber 740. The first set of mounting brackets 750 is sized and configured to receive and hold the first circuitry card 800 within the chassis chamber 740. The first circuitry card 800 is received and held by the first set of mounting brackets 750 by introducing the first circuitry card 800 at the top end 716 of the chassis 700 and progressively moving the first circuitry card 800 away from the top end 716 until the first circuitry card 800 approaches or reaches the bottom end 718 of the chassis 700. Similarly, the second set of mounting brackets 752 is sized and configured to receive and hold the second circuitry card 802 within the chassis chamber 740. The second circuitry card 802 is received and held by the second set of mounting brackets 752 by introducing the second circuitry card 802 at the top end 716 of the chassis 700 and progressively moving the second circuitry card 802 away from the top end 716 until the second circuitry card 802 approaches or reaches the bottom end 718 of the chassis 700. The second portion 722 may include additional electrical components for electrically connecting the first and second circuitry cards 800, 802 to a processor or computer provided on the decoy vehicle 10.

The first and second sets of antennas 400, 450 are electrically connected to the first and second circuitry cards 800, 802 housed within chassis 700. The first set of antennas 400 is electrically connected to the first circuitry card 800 and the second set of antennas 450 is electrically connected to the second circuitry card 802. Such electrical connections between the first and second sets of antennas 400, 450 and the first and second circuitry cards 800, 802 allow for electrical transmission therebetween. For example, signals from the first and second circuitry cards 800, 802 may actuate the first and second sets of antennas 400, 450. Additionally, first and second sets of antennas 400, 450 may output gathered data to the first and second circuitry cards 800, 802 when viewing or capturing the near-vertical FoV for any objects or incoming threats relative to the decoy vehicle 10.

The motor 502 may be electrically connected to a third circuitry card (not illustrated) provided on decoy vehicle. In one exemplary embodiment, the third circuitry card may be provided in the upper portion 12 of the decoy vehicle 10 or at any other location in decoy vehicle 10 including chassis 700. The circuitry cards 800, 802 and the third circuitry card electrically connected to motor 502 may also be operatively connected to a processor (not shown but typically located in the upper portion 12) provided on decoy vehicle. The processor may be provided with programming to operate antenna positioner 100 and the antennas 400, 450 provided thereon. Control of the motor 502 and antenna positioner 100 may be provided via the onboard processor or via a link to a computer onboard the remote naval vessel. The system may operator autonomously or manually by personnel on board the naval vessel.

Having now described the structure and components of antenna positioner 100 and chassis 700 within decoy vehicle 10, a method of use thereof will now be described, particularly with reference to FIG. 9.

As discussed earlier herein, the decoy vehicle 10 may be launched from a launcher provided on a naval vessel or on any other type of support structure (which may also be based on land). After launch, the decoy vehicle 10 travels to a predetermined location measured at a predetermined distance and elevation relative to the naval vessel to be protected by the decoy vehicle 10. The predetermined location, predetermined distance, and predetermined elevation may be programmed into or uploaded to the decoy vehicle's processor. Upon reaching the predetermined location, distance, and elevation, the decoy vehicle 10 deploys its first and second propellers 24, 26 to enable the decoy vehicle 10 to hover in place at the predetermined location relative to the naval vessel. A motor (not illustrated) provided on the decoy vehicle 10, is actuated by the onboard processor or computer to provide power to each of the first and second propellers 24, 26 to enable the hovering of the decoy vehicle 10 at the predetermined location and elevation remote from the naval vessel.

As illustrated in FIG. 1, while the decoy vehicle 10 is in the hovering state the first and second propellers 24, 26 may be operated so as to rotate the decoy vehicle 10 about its longitudinal axis "Y" in either of a clockwise or counterclockwise direction. The reason for this rotation will be described hereafter. Preferably, the longitudinal axis "Y" of the decoy vehicle will be vertically aligned but the decoy vehicle may not be able to constantly remain in this preferred orientation because of wind and other atmospheric conditions.

As illustrated in FIGS. 1 and 2, the antenna positioner 100 is initially in a stowed, collapsed position prior to launch of the decoy vehicle 10 and may remain in this stowed position for a length of time after launch and while decoy vehicle 10 is either moving through the sky or is hovering in the sky. While in the stowed position, antenna positioner remains in the collapsed position (FIG. 5) with the entire frame 300 and all of the antennas 400, 450 located within the interior chamber 30 of the lower portion 14. Additionally, the cover 40 is interlocked with the mounting plate 202 of the base 200 and is attached to the frame 300. (The cover 40 may also be engaged with regions of the exterior wall 32 of the lower portion 14.) While the antenna positioner 100 is in the collapsed position, the first and second sets of antennas 400, 450 are disposed inwardly and rearwardly of the mounting plate front surface 203 of the base 200. As to the attachment between the cover 40 and the mounting plate 202, the first and second extensions (not shown but discussed earlier herein) are disposed within first and second slots 220, 222 of the mounting plate 202, and the first and second sets of attachment legs 46, 47 are operatively engaged with the first and second sets of attachment posts 344, 346 on frame 300. The arrangement between the cover 40 and each of the base 200 and frame 300 provides a barrier between the antenna positioner 100 and the environment beyond the exterior surface 33 of the circumferential wall 32 of the lower portion 14 of the decoy vehicle 100. The wall 32 and cover 40 protect the antenna positioner 100 during the launching process and before deployment thereof.

Once the decoy vehicle 10 is hovering in the sky as shown in FIG. 1, the deployment of the antenna positioner 100 may be initiated by the onboard processor or computer or by a signal sent to the onboard processor or computer from the naval vessel. In order to allow the antenna positioner 100 to move from its collapsed position to its extended position, the cover 40 must be disengaged from its position extending across the opening 34 defined in the exterior wall 32. This may be accomplished in any one of a number of different ways. For example, the third circuitry card (not illustrated) or one of the circuitry cards 800, 802 may send an electronic pulse or signal to the motor 502 to actuate and apply a suitable amount of torque to the drive shaft 510. The suitable amount of torque applied to the drive shaft 510 may be based on the amount of force necessary to detach the cover 40 from the frame 300 and the exterior wall 32. For example, the frame 300 may be pivoted to such an extent that that the first and second sets of attachment legs 46, 47 detach from the frame 300 or the cover 40. In order to apply this force onto the frame 300, the torque is applied to the driving gear 512 via the drive shaft 510. The motor 502 may drive the rotation of the drive shaft 510 and the driving gear 512 about the first axis of rotation "X1". This rotation is indicated by an arrow labeled "A" in FIG. 6A. Driving gear 512 initiates rotation of first continuation gear 520, continuation shaft 522, and second continuation gear 524 about second axis "X2". The rotation about second axis "X2" is in an opposite direction relative to the driving gear 512 indicated by the arrow "B" in FIGS. 6A and 6B. The first continuation gear 520 and second continuation gear 524 then transfers and applies torque to the first frame gear 546, first shaft 355 and second frame gear 556. Upon receiving this torque, the first frame gear 546, first shaft 355 and second frame gear 556 rotate in an opposite direction relative to the first continuation gear 520. The rotation of the first frame gear 546 about the third axis of rotation "X3" is indicated by the arrow "C" in FIGS. 6A and 6B.

Rotation of the first frame gear 546 and second frame gear 556 causes first frame arm 350 and second frame arm 360 to rotate about the third axis of rotation "X3". The rotation of first and second frame arms 350, 360 causes the antenna positioner 100 to pivot in the direction indicated by arrow "D" in FIG. 7, moving the first end 302 of frame 300 towards and then through opening 34 defined in exterior wall 32 of lower portion 14. The interaction between the first continuation gear 520 and the first frame gear 546 and the interaction between the second continuation gear 524 and the second frame gear 556 occur nearly simultaneously. Such interactions between the first continuation gear 520 and the first frame gear 546 and between the second continuation gear 524 and the second frame gear 556 provide substantially equal amounts of force to be applied onto opposing sides of the frame 300. The applied force pivots the frame 300 and may also be used to detach the cover 40 from the frame 300 and base 200.

To detach the cover 40 from the frame 300 and base 200, the first and second attachment posts 344, 346 on frame 300 apply a pushing to first and second attachment legs 46, 47 on cover 40. Additionally, the outer edges of at least one of the antennas in the first set of antennas 400 or at least one of the antennas in the second set of antennas 450 may contact and push on the inner surface 45 of the cover 40 as frame 300 begins to pivot. The motor 502 may exert greater torque onto the frame 300, via the gearing mechanism 500, if the cover 40 cannot readily be detached with a suitable amount of force at a first attempt of detaching the cover 40. Once the cover 40 detaches from the exterior wall 32, the frame 300, and/or the base 200, the cover 40 falls away from the decoy vehicle 10. Since the cover 40 is no longer engaged with the decoy vehicle 10, it will drop downwardly under force of gravity into the sea or onto the land (depending on where decoy vehicle 10 is hovering). Furthermore, once the cover 40 is detached, the frame 300 of the antenna positioner 100 is free to pivot outwardly through the opening 34 that is no longer closed off by cover 40. Continued operation of the motor 502 and gearing mechanism 500 will pivot frame 300 to a sufficient degree that at least a portion of the frame 300 extends outwardly from the chamber 30, through the opening 34, and beyond the exterior surface 33 of the wall 32 of lower portion 14 that defines chamber 30.

In the illustrated embodiment, the first ends 350A, 360A of the first and second frame arms 350, 360 are mechanically fixed to the first and second lateral walls 340, 342 of the frame 300 such that the first ends 350A, 360A of the first and second frame arms 350, 360 will remain stationary along a fourth axis of rotation "X4". The first ends 372A, 380A of the first and second stabilizers 372, 380 are movably attached to the first and second lateral walls 340, 342 of the frame. First ends 372A, 380A of the first and second stabilizers 372, 380 rotate about a fifth axis of rotation "X5". Such a configuration between the first ends 350A, 360A of the first and second frame arms 350, 360 and the first ends 372A, 380A of the first and second stabilizers 372A, 380A allows the frame 300 to pivot between the collapsed position and the expanded position. Similarly, the second ends 372B, 380B of the first and second stabilizers 372, 380 are movably attached to the hanger 250 such that second ends 372B, 380B of the first and second stabilizers 372, 380 rotate about a sixth axis of rotation "X6". The first and second stabilizers 372, 380 help to ensure the frame 300 is able to pivot between the collapsed position and the expanded position by providing lateral support to the frame 300 during operation.

Figure 8:
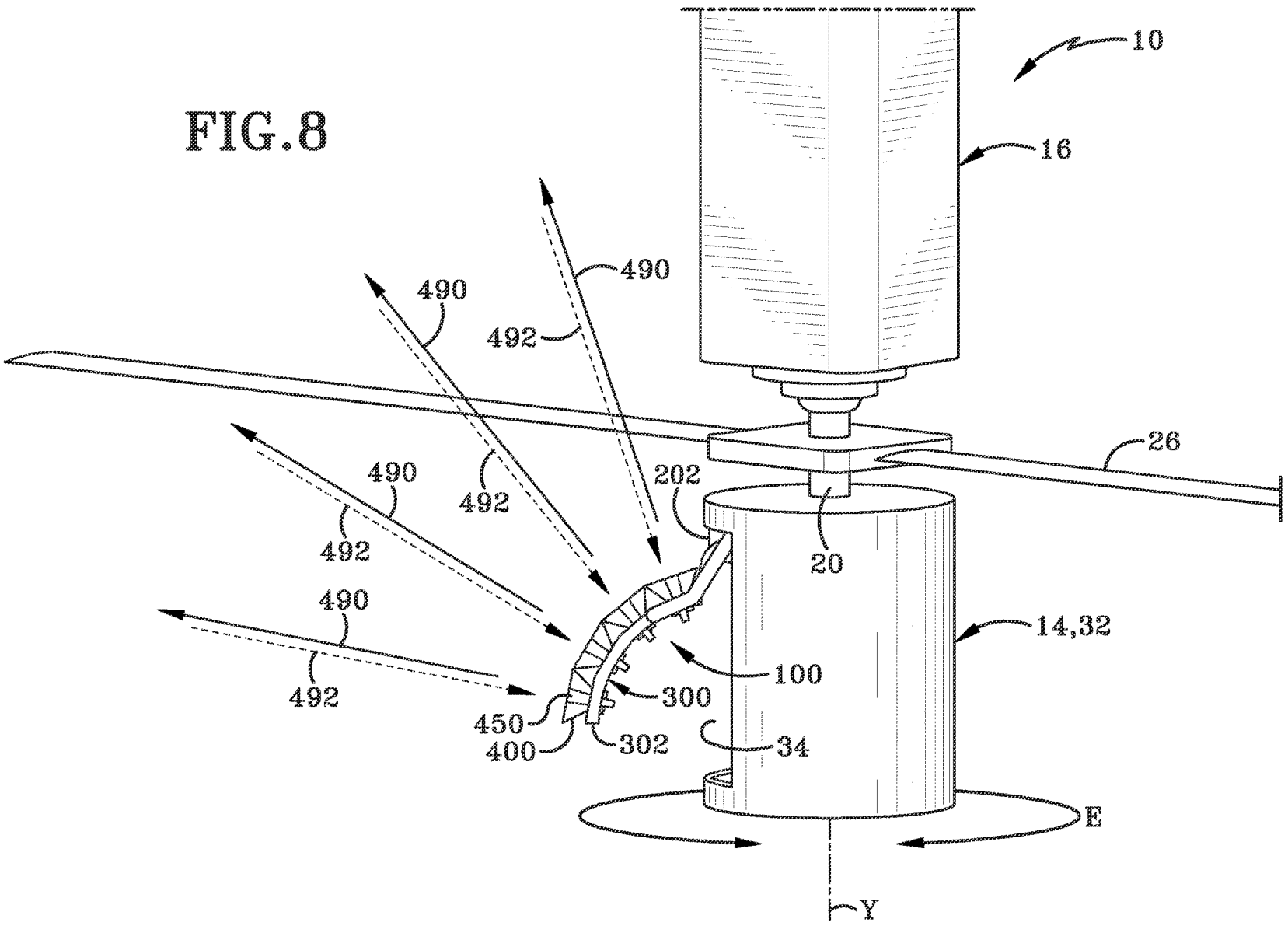
FIG. 8 illustrates a partial perspective view of the decoy vehicle with the antenna positioner in a deployed, extended position where at least a portion of the antenna positioner extends outwardly beyond the exterior wall of the decoy vehicle, and illustrating the improved FoV of the antennas provided on the antenna positioner.

As illustrated in FIGS. 7 and 8, the antenna positioner 100 is shown at its fully extended position such that the frame 300 and the first and second sets of antennas 400, 450 are located outside of the chamber 30 and are exposed to the exterior environment surrounding the decoy vehicle 10. The deployment of antenna positioner 100 to its extended position greatly improves the FoV of each of the antennas 400, 450 mounted on frame 300. In particular, the near-vertical FoV of the antennas 400, 450 is greatly improved relative to previously known decoy vehicles.

It will be understood that the motor 502 and gearing mechanism 500 may be operated to selective adjust the angular position of the antenna positioner 100 relative to the exterior wall 32 of the lower portion 14 and thereby change the position of the antennas 400, 450 relative to the exterior wall 32 of decoy vehicle 10. This adjustment in the orientation of the frame 300 may be undertaken to obtain an optimum or desired FoV with the antennas 400, 450. The adjustment of the antenna positioner 100 involves moving the frame one of further outwardly away from exterior wall 32 in the direction indicated by arrow "D" (FIG. 7) or closer inwardly towards the exterior wall 32 in the direction indicated by arrow "E" (FIG. 7).

It will be understood that the antenna positioner 100 may be pivoted from the fully collapsed position to the fully extended position or to any partially-extended position located between the fully collapsed position and the fully extended position. The particular degree of extension selected will depend upon a number of selected or programmed parameters that match the particular situation in which the decoy vehicle 10 is launched.

Once frame 300 is positioned to the desired orientation relative to the exterior wall 32 of the decoy vehicle 10, the first and second sets of antennas 400, 450 may be actuated/enabled to scan and capture information about objects or incoming threats, particularly in the near-vertical FoV relative to the decoy vehicle 10 (as shown by arrows 490 in FIG. 8). In addition, the first and second sets of antennas 400, 450 are enabled to send electrical signals away from the decoy vehicle 10 for tactical matters (as shown by arrows 492 in FIG. 8) when the antenna positioner 100 is in its extended position. Such capturing and sending of data by the first and second sets of antennas 400, 450 may be controlled by the first and second circuitry cards 800, 802.

As mentioned previously herein, during the viewing and capturing of data phase of the first and second sets of antennas 400, 450, the decoy vehicle 10 may continually or periodically rotate through 360 degrees about its longitudinal axis "Y" in the direction indicated by arrow "F" in FIG. 8. The rotation about longitudinal axis "Y" enables the first and second sets of antennas 400, 450 to scan and capture the entire vertical FoV that surrounds the decoy vehicle 10 while decoy vehicle 10 is hovering in the air. Decoy vehicle 10 may be selectively rotated in either of a clockwise or a counter-clockwise direction about the longitudinal axis "Y" as desired or needed. This rotation of decoy vehicle 10 while antenna positioner is deployed in the extended position greatly improves the FoV of the various antennas 400, 450. Any data gathered during operation of the antennas 400, 450 may be saved in a database provided in the processor of the decoy vehicle 10 and/or may be communicated back to the naval vessel or other remote tactical location from which the decoy vehicle 10 was launched or is controlled. Such rotation of decoy vehicle 10 about the longitudinal axis "Y" also allows the first and second sets of antennas 400, 450 to send electrical signals in all directions away from the decoy vehicle 10.

The frame 300 of the antenna positioner 100 may be actuated to in a plane aligned with the longitudinal axis "Y" or along the longitudinal axis "Y" of the decoy vehicle 10 while at least part of the antenna positioner 100 is in the selected extended position outside of the chamber 30 of the lower portion 14. Such rotation of the frame 300 may occur when an object or incoming threat is traveling at different altitudes which are outside the original vertical FoV of the first and second sets of antennas 400, 450. The rotation of the frame 300 may be made to allow at least one antenna of the first set of antennas 400 and/or at least one antennas of the second set of antennas 450 to view and capture the object or incoming threat at a different altitude. The third circuitry card may initiate the rotation of the frame 300, via the motor 502 acting on the gearing mechanism 500, toward the top end 106 of the antenna positioner 100 to view and capture an object or incoming threat that is traveling at an elevation near the top end 106 of the decoy vehicle 10. The onboard processor or computer may rotate the frame 300, via the motor 502 acting on the gearing mechanism 500, toward the rear end 104 of the antenna positioner 100 to view and capture an object and/or an incoming threat that is traveling at an elevation near the bottom end 108 of the decoy vehicle 10. The onboard processor or computer may continually or periodically rotate the frame 300 toward or away from the exterior wall 32 by sending a plurality of pulses to activate the motor 502 and thereby broaden the FoV of the various antennas 400, 450.

The extended position or partially extended position of the antenna positioner 100 is considered advantageous at least because the first and second sets of antennas 400, 450 are disposed outside of the decoy vehicle to maximize the near-vertical FoV relative to the decoy vehicle 10. Such extension of the frame 300 of the articulating frame 100 allows the first and second sets of antennas 400, 450 to view and capture incoming threats at a greater distance, at a wider range of altitudes relative to the decoy vehicle 10, and with greater accuracy, relative to previously known antennas on decoy vehicles because the FoV of the first and second sets of antennas 400, 450 is not impeded by some of the other structures or components that may be housed within the interior of the decoy vehicle 10. Furthermore, the possible continual adjustment of the position of the frame 300 relative to the exterior wall 32 allows for the first set of antennas 400 and/or the second set of antennas 450 to better track the path of an object or an incoming threat in the near-vertical FoV.

During the hovering state, the first and second sets of antennas 400, 450 are continually operating based on the task at hand (e.g., scanning and capturing the FoV for objects or incoming threats or sending electrical signals for tactical matters). During use, however, the decoy vehicle 10 may rotate laterally along the longitudinal axis "Y" due to external forces asserted against any portion of the decoy vehicle 10 (e.g., wind resistance). As such, certain measurements gathered and recorded by the first and second sets of antennas 400, 450 may be incorrect due to the external forces asserted on the decoy vehicle 10. To correct these errors, the inventors have determined that an azimuth error and an elevation error may be implemented into the data gathered by the first and second sets of antennas 400, 450. In an exemplary embodiment, a suitable correction for the azimuth error is between +/−10 degrees measured relative to the longitudinal axis "Y" of the decoy vehicle in scenarios when the external forces exerted against decoy vehicle 10 are extreme. In another exemplary embodiment, the suitable correction for elevation error is between +/−10 degrees measured relative to the longitudinal axis "Y" of the decoy vehicle in scenarios when the external forces exerted against decoy vehicle 10 are extreme.

When an incoming threat is detected, decoy vehicle 10 is equipped to deploy any of a number of diversion elements as discussed earlier herein and as is well known in the art.

While the antenna positioner 100 and its associated components are disposed in the lower portion 14 of the decoy vehicle 10, it will be understood that the antenna positioner 100 and its associated components may be disposed along and inside any other suitable portion of the decoy vehicle 10. As such, the antenna positioner 100 may be disposed inside of the central portion 16 of the decoy vehicle 10 or the upper portion 12 of the decoy vehicle 10. Such locations may require modifications to the decoy vehicle, specifically to the motors and other electrical components that are used to power and control the first and second propellers, one or more antennas other disposed on the decoy vehicle, and the antenna positioner. Moreover, the antenna positioner 100 preferably should be disposed at a suitable distance away from any additional antennas and various other electrical component located typically in the upper portion 12 of the decoy vehicle 10 so as to prevent or reduce electrical interference therewith. Such distance between the one or more antennas in the upper portion 12 and the antenna positioner 10 is considered advantageous at least because such distance prevents interference between the one or more antennas in the upper portion 12 and the first and second sets of antennas 400, 450 on the antenna positioner 100.

It will be understood while the frame 300 of the antenna positioner 100 has been illustrated and described as pivoting between the collapsed position and the extended position by rotating either away from the exterior wall 32 or towards the exterior wall 32, other suitable mechanisms can be used to move the antenna positioner 100 from a first location where the positioner 100 is stowed within the chamber 30 to a second location where the positioner 100 extends at least partially through the opening 34 and outwardly beyond the exterior wall 32. For example, in one embodiment (not shown), the frame of the antenna positioner may slide linearly outwardly through the opening from a retracted position to an extended position.

It will further be understood that in some instances it may be determined that the decoy vehicle needs to be moved to a different elevation or location and the propellers or another propulsion mechanism may be utilized for this purpose. In this instance, the frame 300 of the antenna positioner 100 may be moved from the extended position back to the collapsed position where the frame 300 is located entirely within the chamber 30 of the lower portion 14. The decoy vehicle 10 may then be moved to its new location and the frame 300 may be redeployed and moved once again to its extended position at least partially outside of the chamber 30.

Figure 9:
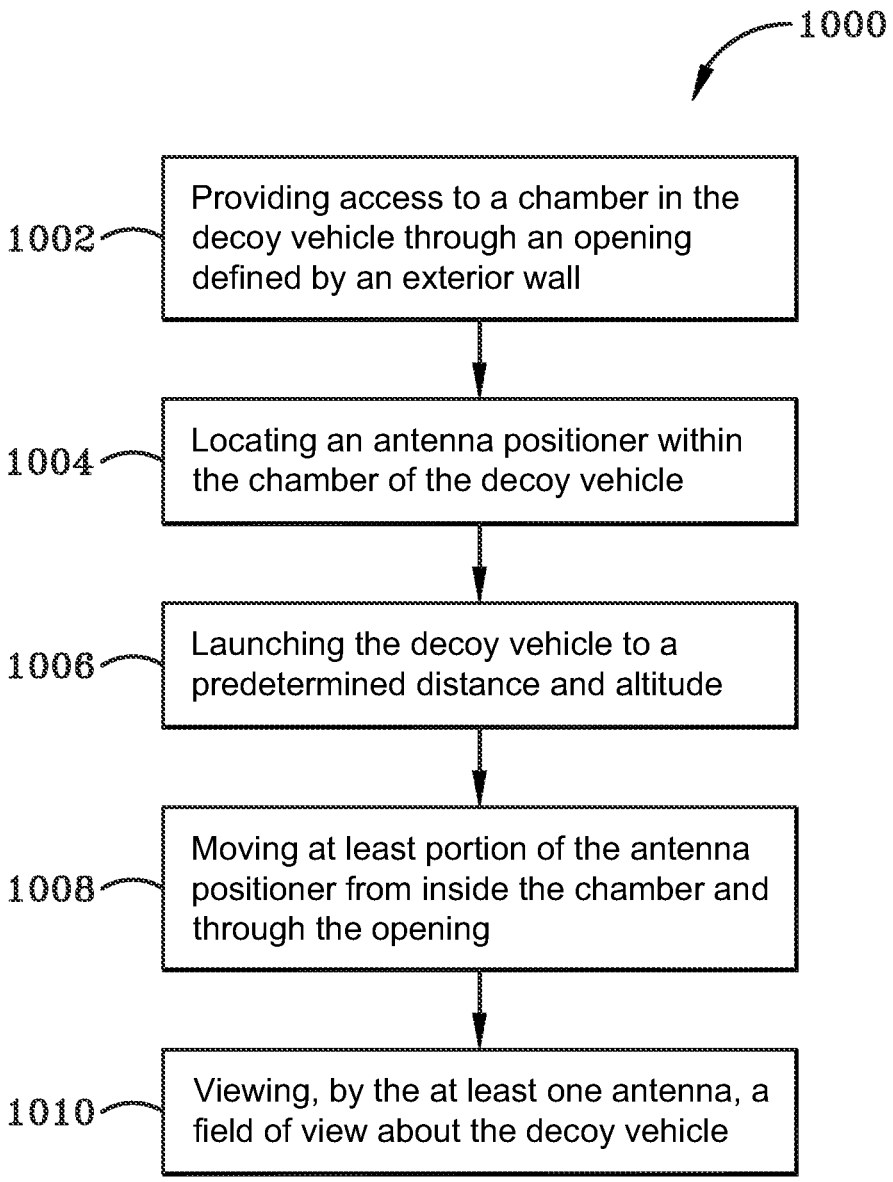
FIG. 9 illustrates an exemplary method flow chart for improving a FoV of a decoy vehicle.

FIG. 9 illustrates a method 1000 of improving a FoV of the decoy vehicle 10. The initial step 1002 of method 1000 comprises providing access to a chamber 30 in the decoy vehicle 10 through an opening 34 defined by an exterior wall 32 of the decoy vehicle. Step 1004 comprises locating an antenna positioner, such as antenna positioner 100, within the chamber 30 of the decoy vehicle 10, and providing at least one antenna 400, 450 on the antenna positioner 100. Step 1006 comprises launching the decoy vehicle 10 to a predetermined distance and altitude. Step 1008 comprises moving at least a portion of the antenna positioner 100 from inside the chamber 30 and through the opening 34 in the exterior wall 32 of the decoy vehicle. Step 1010 comprises viewing, by the at least one antenna 400, 450, a FoV, particularly a near-vertical FoV, about the decoy vehicle 10.

In an exemplary embodiment, method 1000 may include additional steps for improving a FoV of the decoy vehicle 10. An optional step may comprise hovering the decoy vehicle at the predetermined distance and altitude; this optional step may be performed after step 1006 and prior to step 1008. Another optional step may comprise extending a cover over the opening, launching the decoy vehicle, then removing the cover from across the opening to the chamber. Another optional step may comprise sending a signal to move the antenna positioner further away from the chamber and adjusting the FoV; this optional step may be performed after step 1010 and may be repeated. Another optional step may comprise sending a signal to move the antenna positioner closer to the chamber and adjusting the FoV; this optional step maybe performed after step 1010 and may be repeated. Another optional step may comprise rotating the decoy vehicle about the decoy vehicle's longitudinal axis and expanding the FoV of the one or more antennas as the decoy vehicle rotates; this optional step may be performed prior to step 1010 or after step 1010 and may be repeated.

While the antenna positioner 100 is provided on a decoy vehicle, such as decoy vehicle 10, as described and illustrated herein, the antenna positioner 100 may be disposed on other deployable vehicles. In one exemplary embodiment, an antenna positioner may be provided on a satellite vehicle. In this exemplary embodiment, the antenna positioner is movable from a collapsed position inside a chamber of the satellite vehicle to a deployed and extended position where at least part of the antenna positioner extends outwardly beyond the satellite's exterior wall. In another exemplary embodiment, an antenna positioner may be provided on an Unmanned Underwater Vehicle ("UUV"). In this exemplary embodiment, the antenna positioner is movable from a collapsed position inside a chamber of the UUV to a deployed and extended position where at least part of the antenna positioner extends outwardly beyond the UUV's exterior wall.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The above-described embodiments can be implemented in any of numerous ways. For example, embodiments of technology disclosed herein may be implemented using hardware, software, or a combination thereof. When implemented in software, the software code or instructions can be executed on any suitable processor or collection of processors, whether provided in a single computer or distributed among multiple computers. Furthermore, the instructions or software code can be stored in at least one non-transitory computer readable storage medium.

Also, a computer or smartphone utilized to execute the software code or instructions via its processors may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards, and pointing devices, such as mice, touch pads, and digitizing tablets. As another example, a computer may receive input information through speech recognition or in other audible format.

Such computers or smartphones may be interconnected by one or more networks in any suitable form, including a local area network or a wide area network, such as an enterprise network, and intelligent network (IN) or the Internet. Such networks may be based on any suitable technology and may operate according to any suitable protocol and may include wireless networks, wired networks or fiber optic networks.

The various methods or processes outlined herein may be coded as software/instructions that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, various inventive concepts may be embodied as a computer readable storage medium (or multiple computer readable storage media) (e.g., a computer memory, one or more floppy discs, compact discs, optical discs, magnetic tapes, flash memories, USB flash drives, SD cards, circuit configurations in Field Programmable Gate Arrays or other semiconductor devices, or other non-transitory medium or tangible computer storage medium) encoded with one or more programs that, when executed on one or more computers or other processors, perform methods that implement the various embodiments of the disclosure discussed above. The computer readable medium or media can be transportable, such that the program or programs stored thereon can be loaded onto one or more different computers or other processors to implement various aspects of the present disclosure as discussed above.

The terms "program" or "software" or "instructions" are used herein in a generic sense to refer to any type of computer code or set of computer-executable instructions that can be employed to program a computer or other processor to implement various aspects of embodiments as discussed above. Additionally, it should be appreciated that according to one aspect, one or more computer programs that when executed perform methods of the present disclosure need not reside on a single computer or processor, but may be distributed in a modular fashion amongst a number of different computers or processors to implement various aspects of the present disclosure.

Computer-executable instructions may be in many forms, such as program modules, executed by one or more computers or other devices. Generally, program modules include routines, programs, objects, components, data structures, etc. that perform particular tasks or implement particular abstract data types. Typically, the functionality of the program modules may be combined or distributed as desired in various embodiments.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that convey relationship between the fields. However, any suitable mechanism may be used to establish a relationship between information in fields of a data structure, including through the use of pointers, tags or other mechanisms that establish relationship between data elements.

All definitions, as defined and used herein, should be understood to control over dictionary definitions, definitions in documents incorporated by reference, and/or ordinary meanings of the defined terms.

"Logic", as used herein, includes but is not limited to hardware, firmware, software, and/or combinations of each to perform a function(s) or an action(s), and/or to cause a function or action from another logic, method, and/or system. For example, based on a desired application or needs, logic may include a software controlled microprocessor, discrete logic like a processor (e.g., microprocessor), an application specific integrated circuit (ASIC), a programmed logic device, a memory device containing instructions, an electric device having a memory, or the like. Logic may include one or more gates, combinations of gates, or other circuit components. Logic may also be fully embodied as software. Where multiple logics are described, it may be possible to incorporate the multiple logics into one physical logic. Similarly, where a single logic is described, it may be possible to distribute that single logic between multiple physical logics.

Furthermore, the logic(s) presented herein for accomplishing various methods of this system may be directed towards improvements in existing computer-centric or internet-centric technology that may not have previous analog versions. The logic(s) may provide specific functionality directly related to structure that addresses and resolves some problems identified herein. The logic(s) may also provide significantly more advantages to solve these problems by providing an exemplary inventive concept as specific logic structure and concordant functionality of the method and system. Furthermore, the logic(s) may also provide specific computer implemented rules that improve on existing technological processes. The logic(s) provided herein extends beyond merely gathering data, analyzing the information, and displaying the results. Further, portions or all of the present disclosure may rely on underlying equations that are derived from the specific arrangement of the equipment or components as recited herein. Thus, portions of the present disclosure as it relates to the specific arrangement of the components are not directed to abstract ideas. Furthermore, the present disclosure and the appended claims present teachings that involve more than performance of well-understood, routine, and conventional activities previously known to the industry. In some of the method or process of the present disclosure, which may incorporate some aspects of natural phenomenon, the process or method steps are additional features that are new and useful.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

The invention claimed is:

1. An antenna positioner disposed in a deployable vehicle, comprising:

a base provided inside a chamber of the deployable vehicle, the base comprising a mounting plate configured to receive an antenna positioner, wherein the mounting plate directly interfaces an interior surface of the chamber and has a shape that is complementary to the interior surface of the chamber;

a frame moveable relative to the base between a collapsed position and an extended position, wherein the frame is disposed inside the chamber in the collapsed position, and wherein at least a portion of the frame extends outside of the chamber and beyond an exterior wall of the deployable vehicle in the extended position; and at least one antenna provided on the portion of the frame.

2. The antenna positioner according to claim 1, wherein the at least one antenna comprises a first set of antennas provided on the portion of the frame.

3. The antenna positioner according to claim 2, wherein the at least one antenna further comprises:

a second set of antennas provided on the frame, wherein the second set of antennas differ from the first set of antennas.

4. The antenna positioner according to claim 3, wherein each antenna of the first set of antennas is a low band antenna.

5. The antenna positioner according to claim 3, wherein each antenna of the second set of antennas is a high band antenna.

6. The antenna positioner according to claim 1, wherein the at least one antenna includes a first antenna and a second antenna arranged at an angle relative to one another.

7. The antennas positioner according to claim 3, wherein each of the first set of antennas and the second set of antennas comprises four antennas.

8. The antenna positioner according to claim 1, wherein the frame pivots relative to the base between the collapsed position and the extended position.

9. The antenna positioner according to claim 1, further comprising:

a gearing mechanism engaging the base and the frame, wherein the gearing mechanism is operable to articulate the frame relative to the base between the collapsed position and the extended position.

10. A system, comprising:

a deployable vehicle defining a chamber accessible through an opening defined in an exterior wall of the deployable vehicle;

an antenna positioner, comprising:

a base provided inside the chamber of the deployable vehicle, the base comprising a mounting plate configured to receive the antenna positioner, wherein the mounting plate directly interfaces an interior surface of the chamber and has a shape that is complementary to the interior surface of the chamber;

a frame moveable relative to base between a collapsed position and an extended position, wherein the frame is disposed inside the chamber in the collapsed position, and wherein at least a portion of the frame extends outside the chamber through the opening and beyond the exterior wall when in the extended position; and at least one antenna provided on the portion of the frame; and a cover extending over the opening to the chamber when the frame is in the collapsed position, and wherein the cover is removed from over the opening when the frame is moved to the extended position.

11. The system according to claim 10, wherein the at least one antenna comprises of a first set of antennas provided on a portion of the frame.

12. The system according to claim 11, wherein each antenna of the first set of antennas is disposed at an angle relative to each other.

13. The system according to claim 10, further comprising:

a gearing mechanism operably engaged with the base and the frame, the gearing mechanism articulating the frame from the collapsed position to the extended position.

14. The system according to claim 10, wherein the frame pivots relative to the base between the collapsed position and the extended position.

15. A method of improving a Field of View (FoV) of a deployable vehicle, the method comprising:

providing access to a chamber in the deployable vehicle through an opening defined by an exterior wall of the deployable vehicle;

locating an antenna positioner within the chamber of the deployable vehicle, and providing at least one antenna on the antenna positioner, the antenna positioner comprising:

a base provided inside the chamber of the deployable vehicle, the base comprising a mounting plate configured to receive the antenna positioner, wherein the mounting plate directly interfaces an interior surface of the chamber and has a shape that is complementary to the interior surface of the chamber;

a frame moveable relative to base between a collapsed position and an extended position, wherein the frame is disposed inside the chamber in the collapsed position, and wherein at least a portion of the frame extends outside the chamber through the opening and beyond the exterior wall when in the extended position;

launching the deployable vehicle to a predetermined distance and altitude;

moving at least portion of the antenna positioner from inside the chamber and through the opening in the exterior wall; and viewing, by the at least one antenna, a FoV about the deployable vehicle.

16. The method of claim 15, further comprising:

hovering the deployable vehicle at the predetermined distance and altitude.

17. The method of claim 15, further comprising:

extending a cover over the opening then launching then removing the cover; and removing a cover from across the opening to the chamber.

18. The method of claim 15, further comprising:

sending a signal to move the antenna positioner further away from the chamber; and adjusting the FoV.

19. The method of claim 15, further comprising:

sending a signal to move the antenna positioner closer to the chamber; and adjusting the FoV.

20. The method according to claim 15, further comprising:

rotating the deployable vehicle about a longitudinal axis; and expanding the FoV of the one or more antennas as the deployable vehicle rotates.

* * * * *